US008523308B2

(12) United States Patent
Shibata et al.

(10) Patent No.: US 8,523,308 B2
(45) Date of Patent: Sep. 3, 2013

(54) RECORDING HEAD ADJUSTMENT METHOD AND IMAGE RECORDING APPARATUS

(75) Inventors: Hiroyuki Shibata, Kanagawa-ken (JP); Yoshiharu Sasaki, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 288 days.

(21) Appl. No.: 13/030,508

(22) Filed: Feb. 18, 2011

(65) Prior Publication Data

US 2011/0205276 A1 Aug. 25, 2011

(30) Foreign Application Priority Data

Feb. 22, 2010 (JP) ..... 2010-036284

(51) Int. Cl.
*B41J 29/38* (2006.01)
*B41J 29/393* (2006.01)

(52) U.S. Cl.
USPC ..... 347/14; 347/19

(58) Field of Classification Search
None
See application file for complete search history.

(56) References Cited

U.S. PATENT DOCUMENTS 7,213,900 B2 * 5/2007 Ebihara ..... 347/19
2009/0051717 A1 * 2/2009 Kuwahara ..... 347/9

FOREIGN PATENT DOCUMENTS

JP 2009-51066 A 3/2009

* cited by examiner

*Primary Examiner* — Stephen Meier
*Assistant Examiner* — Tracey McMillion
(74) *Attorney, Agent, or Firm* — Birch, Stewart, Kolasch & Birch, LLP

(57) ABSTRACT

A recording head adjustment method includes: a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement; a step-difference amount calculation step of measuring positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtaining an amount of step difference between the sub-heads represented by difference or ratio of the measured positions in the direction of the relative movement of the dot rows for the respective sub-heads; an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value.

12 Claims, 14 Drawing Sheets

RECORDING HEAD ADJUSTMENT METHOD AND IMAGE RECORDING APPARATUS

BACKGROUND OF THE INVENTION

1. Field of the Invention

The present invention relates to a recording head adjustment method and an image recording apparatus, and more particularly, to technology for adjusting a recording head having a structure in which a plurality of sub-heads are joined together.

2. Description of the Related Art

In an inkjet recording apparatus which is a generic image recording apparatus and which forms a desired image on a recording medium by means of an inkjet method, technology is used in which a long line type inkjet head corresponding to the entire width of a recording medium is formed by joining together, in the width direction of the recording medium, short sub-heads which are shorter than the entire width of the recording medium. In an inkjet head having a structure of this kind, installation error of the respective sub-heads produces relative error (step difference) in the depositing positions of the ejected droplets, thus affecting image quality. In order to perform high-quality image recording by eliminating such a step difference, the relative positions of the sub-heads would be better off being adjusted accurately so as to remove step differences between the sub-heads.

However, it is extremely difficult to adjust the relative positions of a plurality of sub-heads accurately by a mechanical method. As a method of correcting relative positional error between sub-heads in the direction of conveyance of the recording medium, it is desirable to use an electrical adjustment method in which the depositing position error in the conveyance direction of the recording medium is measured for each sub-head, the difference in ejection timing corresponding to the depositing position error is determined, and the ejection timing of each sub-head is altered respectively in accordance with this difference in the ejection timing.

Japanese Patent Application Publication No. 2009-51066 discloses technology which determines depositing position errors with respect to a reference position in the sub-scanning direction for each small head of a large head which is constituted by a plurality of small heads having a plurality of ejection units, and optimizes the reading address of print data and the printing timing for each small head.

A method of correcting step differences between sub-heads by an electrical method in an inkjet head having a structure formed by joining together a plurality of sub-heads is now described.

FIG. 11 is a partial enlarged diagram of a pattern 300 formed in order to measure the amount of step difference between sub-heads, and depicts an enlarged view of the portion formed by an overlapping portion (joint portion) between sub-heads. The vertical direction in FIG. 11 is the direction of movement of the recording medium, and the left/right direction is the direction of alignment of the sub-heads. The term "overlapping portion between sub-heads" means a portion where there is a mixture of nozzles belonging to one sub-head and nozzles belonging to another sub-head in a projected nozzle group in which the nozzles belonging to the two mutually adjacent sub-heads are projected so as to align in a direction substantially perpendicular to the direction of movement of the recording medium. In other words, droplets ejected from an overlapping portion between sub-heads include droplets ejected from different sub-heads, which are deposited at mutually adjacent positions in the direction substantially perpendicular to the direction of movement of the recording medium.

The pattern 300 shown in FIG. 11 is formed by an overlapping portion between an $i^{th}$ sub-head and an $(i+1)^{th}$ sub-head, and includes a group of horizontal lines 302 (302-1, 302-2, . . . , 302-7) formed by the $i^{th}$ sub-head and a group of horizontal lines 304 (304-1, 304-2, . . . , 304-7) formed by the $(i+1)^{th}$ sub-head, the lines of the respective groups being arranged in alternating fashion. In other words, a pattern 300 in which horizontal lines 302-1 to 302-7 constituting the horizontal line group 302 and horizontal lines 304-1 to 304-7 constituting the horizontal line group 304 are arranged alternately at a uniform pitch in the direction of conveyance of the recording medium is formed, by driving the $i^{th}$ sub-head at a prescribed drive cycle to form a group of horizontal lines 302 arranged at a prescribed pitch in the direction of movement of the recording medium, and also driving the $(i+1)^{th}$ sub-head at the same drive cycle as the $i^{th}$ sub-head and at a time interval of ½ of the drive cycle of the $i^{th}$ sub-head, from the driving timing of the $i^{th}$ sub-head.

As shown in FIG. 11, in the pattern 300 which is actually formed, the pitch $P_1$ between the horizontal line 302-1 formed by the $i^{th}$ sub-head and the horizontal line 304-1 formed by the $(i+1)^{th}$ sub-head is smaller than the pitch $P_2$ between the horizontal line 304-1 formed by the $(i+1)^{th}$ sub-head and the horizontal line 302-2 formed by the $i^{th}$ sub-head. In other words, the position of the $(i+1)^{th}$ sub-head in the direction of movement of the recording medium is displaced toward the downstream side (the upper side in FIG. 11). Cases such as this are corrected by delaying the drive timing of the $(i+1)^{th}$ sub-head in accordance with the amount of displacement of the depositing positions.

FIG. 12 shows a pattern 300' formed by using an inkjet head in which the drive timings of respective sub-heads have been adjusted as described above. The pattern 300' shown in FIG. 12 is an enlarged view of a portion formed by an overlapping portion between sub-heads. In the horizontal lines which constitute the pattern 300' shown in FIG. 12, there are regions where bending occurs, and therefore the measurement values vary depending on which region is the subject of measurement and it is difficult to ascertain the pitch between the horizontal lines accurately. For example, looking at the first horizontal line 302'-1 in FIG. 12 and the second horizontal line from the top 304'-1, the pitch at the left end is $P_1$, whereas the pitch at the right end is $P_1'$ (>P1), and hence the measurement result changes with the measurement position. If accurate measurement results are not obtained in this way, then it is not possible to evaluate the step differences between sub-heads accurately, and therefore it is difficult to eliminate these step differences. If step differences of this kind are not adjusted accurately, then the image quality declines as a result. On the other hand, it is possible to adjust for step differences with a certain degree of accuracy by repeating steps of measurement and adjustment, but the amount of work involved in the adjustment process increases dramatically.

Furthermore, although the nozzle surface (liquid ejection surface) in which the nozzle holes are formed has a prescribed flatness in each individual sub-head, the nozzle surface bends slightly during processing for forming the nozzle holes and during assembly for fixing the sub-heads to a housing. The example shown in FIG. 13A is a case where a nozzle surface 312 is bent in the direction of movement of the recording medium. The nozzle surface 312 receives pressure from the interior of the head 310 and therefore the bending of the nozzle surface 312 is convex toward the direction of ejection of the liquid. In this case, the direction of ejection of the liquid in the edge portions 314 of the sub-head (labeled with reference numeral A) is the normal direction to the curved surface and therefore displacement occurs in the depositing positions in the direction of movement of the recording medium. The positions labeled with reference numerals 320 and 322 in FIG. 13A are the original depositing positions, and the positions labeled with reference numerals 320', 322' are the actual depositing positions in which positional displacement has occurred. On the other hand, in substantially the central portion of the sub-head, since the liquid is ejected in a direction perpendicular to the recording medium 316, then the ejected droplets land in the original depositing position 324.

Depositing position displacement caused by bending of the nozzle surface 312 affects the step difference in the overlapping portion between sub-heads. FIG. 13B is an enlarged diagram showing an enlarged schematic view of the overlapping portion between the $i^{th}$ sub-head 310-*i* and the $(i+1)^{th}$ sub-head 310-(*i*+1). Droplets ejected from the −Y side nozzles 330A in the nozzle arrangement in the column direction (an oblique direction forming a prescribed angle with respect to the Y direction) land further in the −Y direction (indicated by the upward pointing arrows in FIG. 13B), and droplets ejection from the +Y side nozzles 330B land further in the +Y direction (indicated by the downward pointing arrows in FIG. 13B). On the other hand, the displacement in the depositing positions of droplets ejected from the nozzles 330C in substantially the central portion in the column direction of the nozzle arrangement is relatively small.

Furthermore, since the extent of bending is different in the sub-head 310-*i* and the sub-head 310-(*i*+1), then the extent of displacement of the depositing positions is different for each sub-head. The length of an arrow shown in FIG. 13B represents the amount of depositing position displacement, and it can be seen that the amount of depositing position displacement is smaller in the sub-head 310-(*i*+1) than in the sub-head 310-*i*. In particular, there is marked depositing position displacement between droplets ejected from nozzles on the −Y direction side in the nozzle arrangement in the column direction and droplets ejected from nozzles on the +Y direction side.

In the technology disclosed in Japanese Patent Application Publication No. 2009-51066, although it is conceivable that bending may occur in the horizontal lines in the portions formed by the overlapping portions between sub-heads, Japanese Patent Application Publication No. 2009-51066 does not disclose a method for eliminating depositing position error in the droplets formed by overlapping portions between sub-heads. Consequently, even if the technology disclosed in Japanese Patent Application Publication No. 2009-51066 is used, it is difficult to ascertain the step differences between sub-heads accurately, and to correct the step differences between sub-heads completely. Furthermore, Japanese Patent Application Publication No. 2009-51066 makes no mention of focusing on the depositing position error of the droplets caused by bending of the nozzle surface and does not describe technology for eradicating a depositing position error of this kind.

SUMMARY OF THE INVENTION

The present invention has been contrived in view of these circumstances, an object thereof being to provide a recording head adjustment method and an image recording apparatus whereby step differences between sub-heads in a recording head having a structure in which a plurality of sub-heads are joined together can be ascertained accurately and desirable image recording in which the step differences have been corrected can be achieved.

In order to attain an object described above, one aspect of the present invention is directed to a recording head adjustment method comprising: a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement; a step-difference amount calculation step of measuring positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtaining an amount of step difference between the sub-heads represented by difference or ratio of the measured positions in the direction of the relative movement of the dot rows for the respective sub-heads; an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value.

Another aspect of the present invention is directed to a recording head adjustment method comprising: a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement; a step-difference amount calculation step of measuring positions in the direction of the relative movement of the dot rows formed by the respective sub-heads are measured by taking, as a measurement object, a region formed by using the recording elements belonging to a central portion including the central recording element in the direction of the relative movement, and obtaining an amount of step difference between the sub-heads represented by difference or ratio of the measured positions in the direction of the relative movement of the dot rows for the respective sub-heads; an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value.

Another aspect of the present invention is directed to an image recording apparatus comprising: a recording head having a structure in which a plurality of sub-heads each including a plurality of recording elements are joined together; a recording head drive device which causes relative movement between a recording medium and the recording head and drives the plurality of recording elements at prescribed drive timing with respect to each of the plurality of sub-heads; a drive control device which controls the recording head drive device to form dot rows for the respective sub-heads, the dot rows extending in a direction substantially perpendicular to a direction of the relative movement; a step-difference amount calculation device which measures positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtains an amount of step difference between the sub-heads represented by difference or ratio of the measured positions in the direction of the relative movement of the dot rows for the respective sub-heads; an adjustment value calculation device which calculates an adjustment value for the drive timing of the plurality of recording elements with respect to each of the plurality of sub-heads according to the obtained amount of step difference; and a drive timing adjustment device which adjusts relative drive timing with respect to each of the plurality of sub-heads according to the calculated adjustment value.

Another aspect of the present invention is directed to an image recording apparatus comprising: a recording head having a structure in which a plurality of sub-heads each including a plurality of recording elements are joined together; a recording head drive device which causes relative movement between a recording medium and the recording head and drives the plurality of recording elements at prescribed drive timing with respect to each of the plurality of sub-heads; a drive control device which controls the recording head drive device to form dot rows for the respective sub-heads, the dot rows extending in a direction substantially perpendicular to a direction of the relative movement; a step-difference amount calculation device which measures positions in the direction of the relative movement of the dot rows formed by the respective sub-heads are measured by taking, as a measurement object, a region formed by using the recording elements belonging to a central portion including the central recording element in the direction of the relative movement, and obtains an amount of step difference between the sub-heads represented by difference or ratio of the measured positions in the direction of the relative movement of the dot rows for the respective sub-heads; an adjustment value calculation device which calculates an adjustment value for the drive timing of the plurality of recording elements with respect to each of the plurality of sub-heads according to the obtained amount of step difference; and a drive timing adjustment device which adjusts relative drive timing with respect to each of the plurality of sub-heads according to the calculated adjustment value.

According to the present invention, when measuring the positions of dot rows formed by respective sub-heads, a region where the recording rates are substantially the same as each other, of the portion formed by the overlapping portion between sub-heads, is taken as a measurement object, and therefore it is possible to reduce error in the measurement results and the step difference between sub-heads can be measured with good accuracy.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Structure of Inkjet Head

Figure 1:
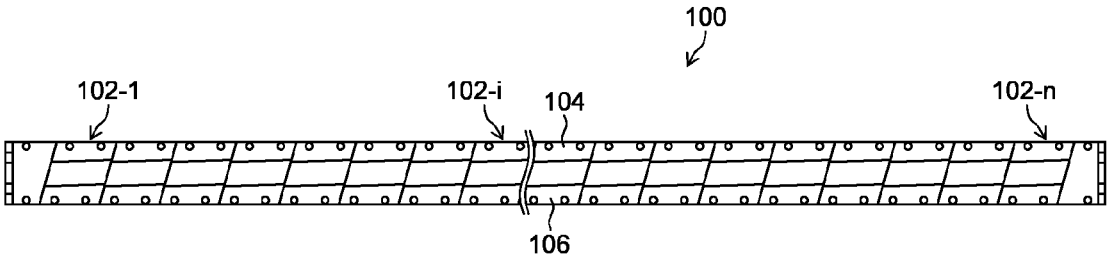
FIG. 1 is a plan diagram showing the structure of an inkjet head to which the adjustment method relating to an embodiment of the present invention is applied.

FIG. 1 is a general schematic drawing of an inkjet head to which a sub-head adjustment method relating to an embodiment of the present invention is applied, and shows a view of a recording surface of a recording medium as observed from the inkjet head 100 (a plan view perspective diagram of the inkjet head).

The head 100 shown in FIG. 1 is a multi-head formed by joining together n sub-heads 102-*i* (where i is an integer from 1 to n), in one row in a direction (a breadthways direction of the recording medium) substantially perpendicular to the direction of movement of the recording medium. Furthermore, the sub-heads 102-*i* are supported by head covers 104 and 106 from either side of the direction in which the shorter sides of the head 100 extends, and are fixed to a housing. It is also possible to constitute a multi-head by arranging sub-heads 102 in a staggered configuration.

One example of the application of a multi-head constituted by a plurality of sub-heads is a full-line head which corresponds to the entire width of a recording medium. A full line head has a structure in which a plurality of nozzles (labeled with the reference numeral 108 in FIG. 3) are arranged through the length (width) of the recording medium in the direction of movement of the recording medium, following a direction (main scanning direction) which is perpendicular to the direction of movement of the recording medium (sub-scanning direction). An image can be formed over the full surface of the recording medium by means of a so-called single-pass image recording method in which image recording is carried out by performing just one relative scanning action of a head 100 having this structure and a recording medium.

Figure 2:
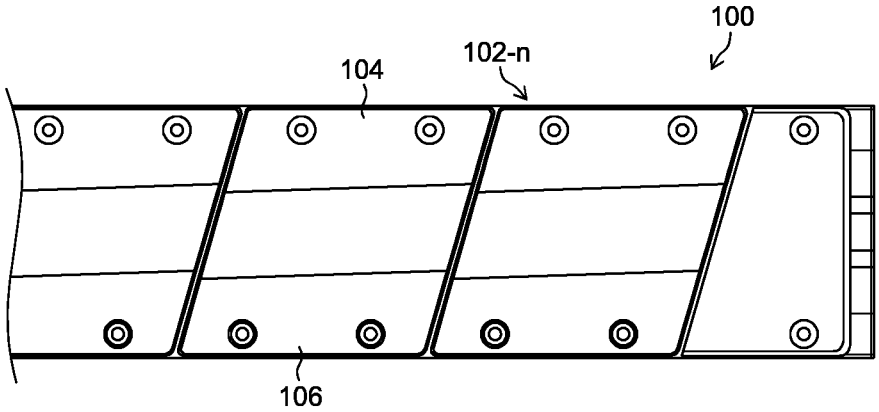
FIG. 2 is a partial enlarged diagram of the inkjet head shown in FIG. 1.

FIG. 2 is a partial enlarged diagram of the head 100. As shown in FIG. 2, the sub-head 102 has a substantially parallelogram-shaped planar form and overlapping portions are provided between adjacent sub-heads (the overlapping portions are labeled with reference numeral 103 in FIG. 6A). The details of the arrangement of nozzles in the "overlapping portions" are described below.

Figure 3:
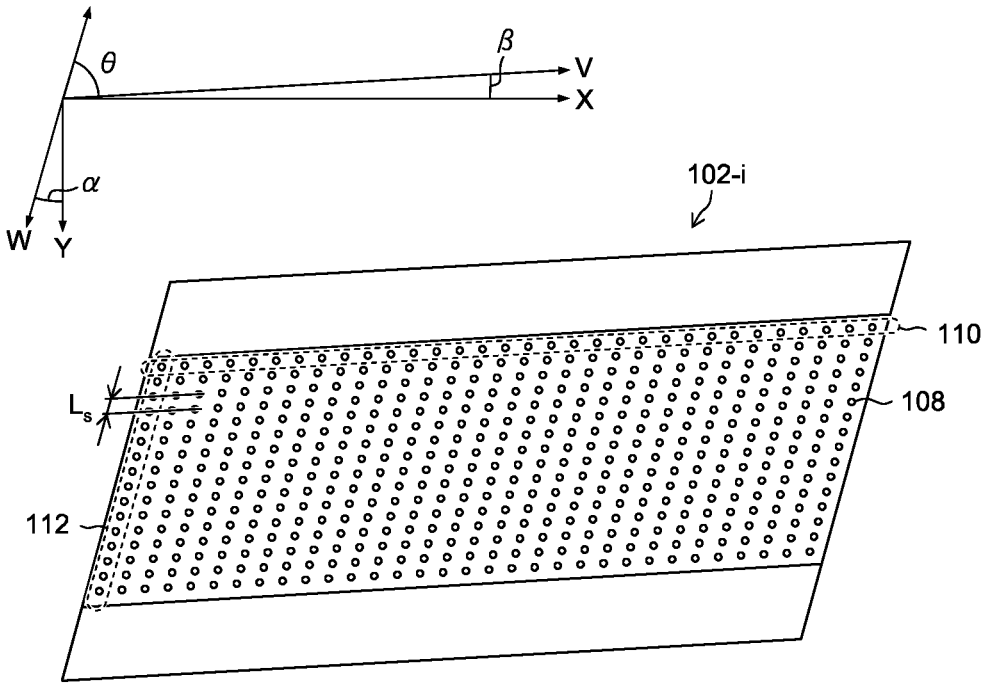
FIG. 3 is a diagram illustrating a nozzle arrangement in a sub head shown in FIG. 1.

FIG. 3 is a plan diagram showing a nozzle arrangement in a sub-head 102-*i*. As shown in FIG. 3, each sub-head 102-*i* has a structure in which nozzles 108 are arranged in a two-dimensional configuration, and a head which includes sub-heads 102-*i* of this kind is known as a so-called matrix head.

The sub-head 102-*i* shown in FIG. 3 has a structure in which a plurality of nozzles 108 are arranged in a column direction W that forms an angle α with respect to the relative movement direction Y of the recording medium and the head 100 (sub-scanning direction), and a row direction V that forms an angle β with respect to the direction X of arrangement of the sub-heads 102-*i* (main scanning direction), thereby achieving a high density of the effective nozzle arrangement density in the main scanning direction X. In FIG. 3, a nozzle group (nozzle row) arranged in the row direction V is labeled with reference numeral 110, and a nozzle group (nozzle column) arranged in the column direction W is labeled with the reference numeral 112.

The nozzles arrangement which can be employed in embodiments of the present invention is not limited to the nozzle arrangement shown in FIG. 3; for example, the present invention can also be applied to a mode where a plurality of nozzles are arranged in matrix configuration in a row direction following the main scanning direction X and in a column direction which is oblique with respect to the main scanning direction X and the sub-scanning direction Y.

Figure 4:
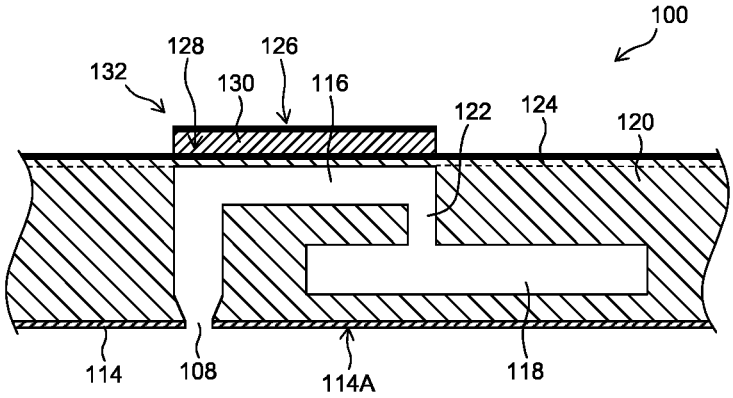
FIG. 4 is a cross-sectional diagram showing a structure of a sub head shown in FIG. 1.

FIG. 4 is a cross-sectional diagram showing the composition of a droplet ejection element of one channel which is the minimum unit of the recording elements (namely, an ink chamber unit corresponding to one nozzle 108). As shown in FIG. 4, the head 100 according to the present embodiment has a structure in which a nozzle plate 114 in which nozzles 108 are formed, and a flow channel plate 120, and the like, in which flow channels such as pressure chambers 116 and a common flow channel 118, and the like, are formed are layered and bonded together. The nozzle plate 114 constitutes the nozzle surface 114A of the head 100 and a plurality of nozzles 108 which are connected respectively to the pressure chambers 116 are formed in a two-dimensional configuration therein.

The flow channel plate 120 is a flow channel forming member which constitutes side wall portions of the pressure chambers 116 and in which a supply port 122 is formed to serve as a restricting section (most constricted portion) of an individual supply channel for guiding ink to each pressure chamber 116 from the common flow channel 118. For the sake of the description, a simplified view is given in FIG. 4, but the flow channel plate 120 has a structure formed by one substrate or layering together a plurality of substrates.

The nozzle plate 114 and the flow channel plate 120 can be processed into a required shape by a semiconductor manufacturing process using silicon as a material.

The common flow channel 118 is connected to an ink tank (not shown), which is a base tank that supplies ink, and the ink supplied from the ink tank is supplied through the common flow channel 118 to each pressure chamber 116.

An individual electrode 126 and a lower electrode 128 are provided on a diaphragm 124 which constitutes a portion of the surface of the pressure chamber 116 (the ceiling face in FIG. 4) and a piezo actuator 132 having a structure in which a piezoelectric body 130 is sandwiched between the individual electrode 126 and the lower electrode 128 is bonded thereto. If the diaphragm 124 is constituted by a metal thin film or a metal oxide film, then the diaphragm 124 also functions as a common electrode which corresponds to the lower electrode 128 of the piezoelectric actuator 132. In a mode in which a diaphragm is made from a non-conductive material, such as resin, a lower electrode layer made of a conductive material, such as metal, is formed on the surface of the diaphragm material.

When a drive voltage is applied to the individual electrode 126, the piezo actuator 132 deforms, thereby changing the volume of the pressure chamber 116. This causes a pressure change which results in ink being ejected from the nozzle 108. When the piezo actuator 132 returns to its original state after ejecting ink, the pressure chamber 116 is replenished with new ink from the common flow channel 118 via the supply port 122. The ink ejection method which can be employed in embodiments of the present invention is not limited to a piezo jet system, and it is also possible to employ a thermal method which ejects droplets by heating a liquid inside a liquid chamber by means of a heater provided in the liquid chamber and utilizing the resulting film boiling phenomenon of the liquid.

A high-density nozzle head according to the present embodiment is achieved by arranging a plurality of ink chamber units having a structure of this kind in a lattice configuration according to a prescribed arrangement pattern in a row direction V that forms an angle β with respect to the main scanning direction X and a column direction W that forms an angle α with respect to the sub-scanning direction Y, as shown in FIG. 3. If the pitch between adjacent nozzles in the sub-scanning direction is taken to be $L_s$, then this matrix arrangement can be treated as equivalent to a configuration where nozzles 108 are effectively arranged in a single straight line at a uniform pitch of $P=L_s/\tan\theta$ apart in the main scanning direction.

Drive Unit of Inkjet Head

Figure 5:
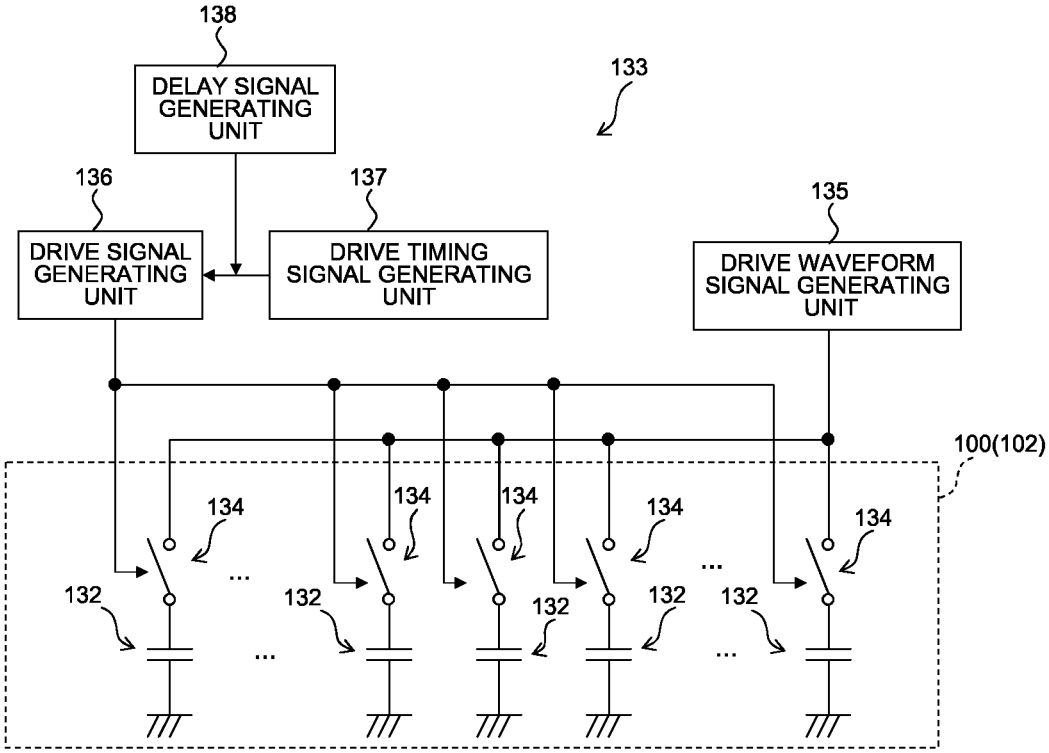
FIG. 5 is a block diagram showing an example of the composition of a driving circuit of the inkjet head shown in FIG. 1.

FIG. 5 is a block diagram showing an example of the composition of a drive unit which supplies electrical signals for operating piezo actuators 132 provided in the inkjet head 100. The drive unit 133 shown in FIG. 5 is provided for each sub-head 102-*i* (see FIG. 1) and simultaneously supplies a common drive waveform signal to the sub-heads 102-*i* forming a drive object. The drive unit 133 uses a method of controlling the ejection timing with respect to each nozzle 108 by turning switch elements 134 which are provided respectively for the nozzles 108 (see FIG. 4) (for each piezo actuator 132) on and off by means of a prescribed drive signal.

The drive unit 133 shown in FIG. 5 includes a drive waveform signal generating unit 135 which generates a common drive waveform signal that is supplied to all of the piezo actuators 132 provided in the sub-heads 102-*i* which is the drive object, a drive signal generating unit 136 which generates a drive signal for controlling the operational timing of each piezo actuator 132, a drive timing signal generating unit 137 which generates a drive timing signal based on a prescribed reference clock, and a delay signal generating unit 138 for adjusting (delaying) the drive timing for each sub-head 102-*i*.

The drive waveform signal generating unit 135 is a block which applies voltage amplification and current amplification to a waveform signal stored in a prescribed memory, and generates electrical energy required in order to operate a piezo actuator 132. One structural example of the drive waveform signal generating unit 135 is a composition including a drive waveform storage unit which stores a drive waveform, a power source (power supply unit), and a current and voltage amplifier unit.

The drive timing signal generating unit 137 is a block which generates a drive timing signal representing a drive (ejection) cycle for each sub-head 102-*i*, and one example of the composition thereof includes a reference clock generating unit which generates a reference clock of several MHz, and a frequency dividing unit which performs frequency dividing of the reference clock. The piezo actuators 132 provided to correspond to the nozzles operate in synchronism with the drive cycle.

The delay signal generating unit 138 is a block which sets a delay time for each sub-head 102-*i* in order to adjust the step differences between sub-heads. As shown in FIG. 1, a head 100 having a structure in which a plurality of sub-heads 102-*i* are joined in a prescribed direction produces relative error in the installation position in a direction perpendicular to the direction of arrangement of the sub-heads 102-1 to 102-*n* (in other words, the direction of movement of the recording medium), and hence step differences occur in the recorded image. In order to eliminate step differences between the sub-heads of this kind, a delay time corresponding to the step difference is set for each of the sub-heads 102-1 to 102-*n*.

Adjustment of Step Difference Between Sub-Heads

Next, the adjustment of the step differences between the sub-heads described above will be described in detail. In the step difference adjustment method described in the present embodiment, a prescribed chart is recorded on a recording medium, the amount of step difference Δy is determined from the relative positional difference between the sub-heads, on the basis of this chart, and the relative delay (delay time) Δt between the sub-heads is determined in accordance with the amount of step difference Δy. When image recording is performed, the drive timing is adjusted in accordance with this delay Δt.

Figure 6A:
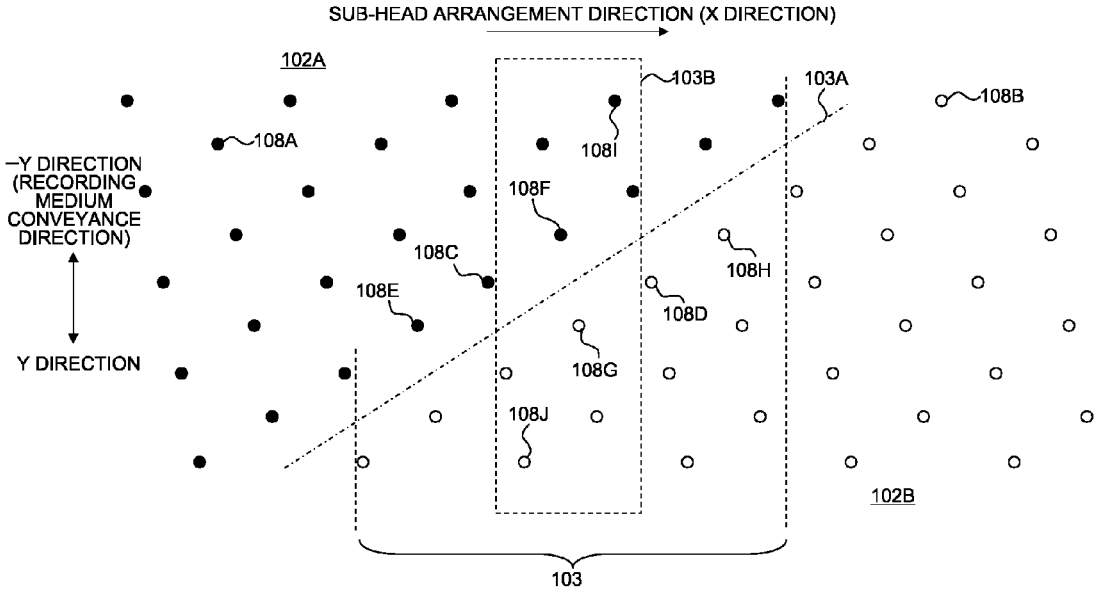
FIGS. 6A and 6B are plan view perspective diagrams showing an example of the structure of an overlapping portion of the inkjet head shown in FIG. 1.
Figure 6B:
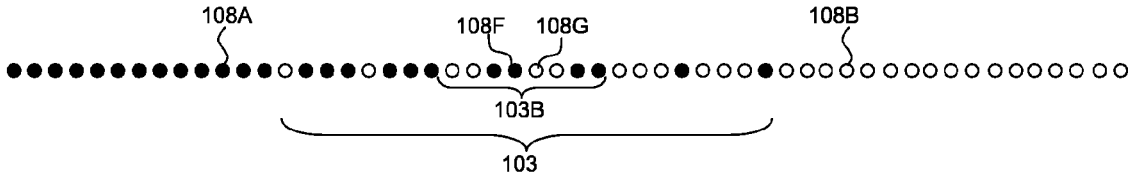

FIG. 6A is a diagram showing the arrangement of nozzles 108 in an overlapping portion 103 between a sub-head 102A and a sub-head 102B which are mutually adjacent, and FIG. 6B is a diagram showing a projected nozzle group in which the nozzles 108 shown in FIG. 6A are projected so as to align in the direction of arrangement of the sub-heads (X direction). The X direction and the Y direction in FIG. 6A coincide with the X direction and the Y direction in FIG. 3.

In FIG. 6A, the nozzles 108A depicted as black dots are nozzles belonging to the sub-head 102A and the nozzles 108B depicted as white dots are nozzles belonging to the sub-head 102B. The single-dotted line labeled with reference numeral 103A in FIG. 6A represents the boundary between the sub-head 102A and the sub-head 102B. Furthermore, the region surrounded by the dotted line labeled with reference numeral 103B indicates a region in which, of the projected nozzle group shown in FIG. 6B, the ratio of nozzles belonging to sub-head 102A and the nozzles belonging to sub-head 102B is the same (namely, a region in which the number of nozzles per unit surface area in the sub-head 102A and the number of nozzles per unit surface area in the sub-head 102B (the nozzle density) is the same).

The downward direction in FIG. 6A is the +Y direction and the upward direction is the −Y direction. The −Y direction is the direction of movement of the recording medium when the recording medium is moved with respect to the fixed inkjet head 100. Furthermore, the nozzles indicated by reference numerals 108E, 108F, 108G and 108H are examples of nozzles included in the "central portion in the Y direction of the nozzles arrangement of the sub-heads 102A and 102B" described below, the nozzle indicated by reference numeral 1081 is an example of a nozzle in the end portion in the −Y direction, and the nozzle indicated by reference numeral 108J is an example of a nozzle in the end portion in the +Y direction.

In the overlapping portion 103 in the projected nozzle group shown in FIG. 6B, the ratio of nozzles 108A belonging to the sub-head 102A and the nozzles 108B belonging to the sub-head 102B varies in a 4-nozzle cycle. From the left-hand side of FIG. 6B, there are two successive regions, each constituted by one nozzle 108B which belongs to the sub-head 102B and three nozzles 108A which belong to the sub-head 102A, followed by two successive regions, each constituted by two nozzles 108B which belong to the sub-head 102B and two nozzles 108A which belong to the sub-head 102A (the region 103B encircled by the dotted line in FIG. 6A), followed by two successive regions, each constituted by three nozzles 108B which belongs to the sub-head 102B and one nozzle 108A which belongs to the sub-head 102A.

In other words, in the projected nozzle group shown in FIG. 6B, from the left-hand side in the drawing, the nozzle density of the sub-head 102A decreases gradually while the nozzle density of the sub-head 102B increases gradually, and in the center of the overlapping portion 103, the nozzle density of the sub-head 102A and the nozzle density of the sub-head 102B are the same.

Figure 7:
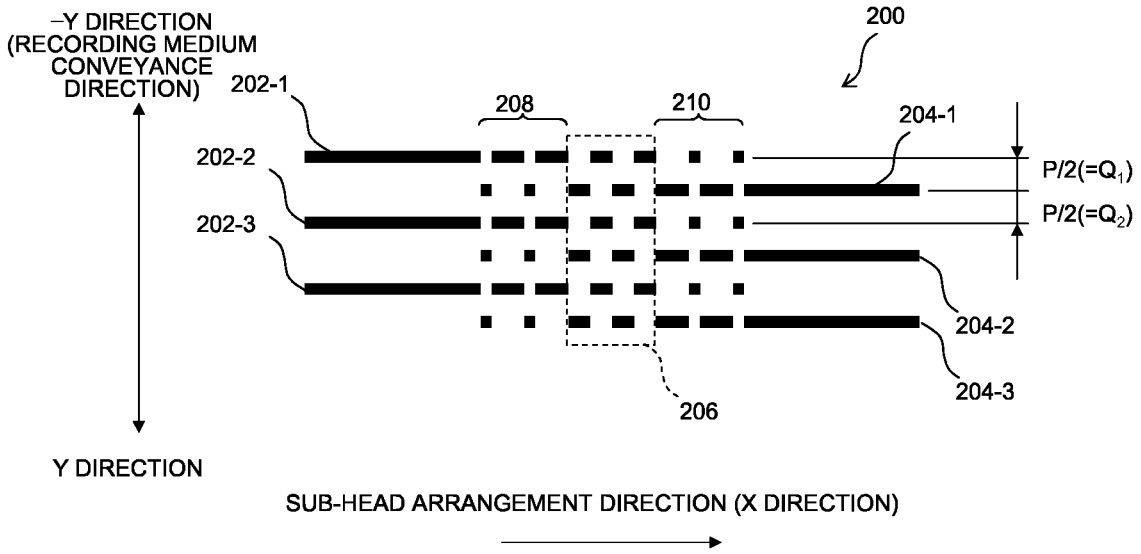
FIG. 7 is a diagram showing horizontal lines recorded by the overlapping portion shown in FIGS. 6A and 6B.

FIG. 7 is an illustrative diagram of a chart for determining the amount of step difference Δy between sub-heads, which is recorded by using the inkjet head 100 including the sub-heads 102 having the nozzle arrangement described above. The chart 200 shown in FIG. 7 shows an enlarged view of a portion formed by an overlapping portion 103 between sub-heads described with reference to FIGS. 6A and 6B, and the vicinity of this portion.

In the chart 200 shown in FIG. 7, a plurality of patterns 202 (202-1 to 202-3) formed by the sub-head 102A and a plurality of patterns 204 (204-1 to 204-3) formed by the sub-head 102B are arranged alternately in the Y (−Y) direction. In other words, the patterns 202 are formed repeatedly by using the sub-head 102A and the patterns 204 are formed by using the sub-head 102B repeatedly. In this case, the pitch between the patterns 202 and 204 is standardized.

Moreover, at least an effective gap is present between the pattern 202-1 and the pattern 202-2, and between the pattern 202-2 and the pattern 202-3, which are recorded by using one sub-head 102A, a pattern 204-1 formed using the other sub-head 102B is formed between the patterns 202-1 and 202-2 which are formed using one sub-head 102A, and an effective gap is present between the pattern 202-1 and the pattern 204-1, and between the pattern 204-1 and the pattern 202-2.

In the chart 200 shown in FIG. 7, the portion formed by the overlapping region 103 between sub-heads has positions where dot (pixels) are missing, these positions corresponding to positions where nozzles of the projected nozzle group shown in FIG. 6B are not present. For example, in the patterns 202-1, 202-2, 202-3, one-dot omission portions, two-dot omission portions and three-dot omission portions occur respectively in two places each. Furthermore, the patterns 204 have dots equal in number to the omitted dots of the patterns 202 which correspond to the dot omission portions of the patterns 202, and have dot omission portions equal in number to the number of dots corresponding to the portion where the dots are present in the pattern 202. More specifically, the patterns 202 and the patterns 204 in the position corresponding to the overlapping portion between sub-heads are composed in such a manner that the respective dot omissions of each are mutually compensated.

The width of the patterns 202 and the width of the patterns 204 shown in FIG. 7 are one pixel each (corresponding to 21.7 μm) in the image data, and in actual image formation, the width is 50 μm (20 μm to 60 μm). Furthermore, the pitch between the pattern 202-1 and the pattern 202-2 and the pitch between the pattern 202-2 and the pattern 202-3, which are formed using the sub-head 102A, are P, and the pitch between the pattern 204-1 and the pattern 204-2 and the pitch between the pattern 204-2 and the pattern 204-3 which are recorded using the sub-head 102B are also P.

Moreover, the pitch between the pattern 204-1 which is formed by using the sub-head 102B and the patterns 202-1 and 202-2 which are formed by using the sub-head 102A is P/2. Similarly, the pitch between the pattern 204-2 which is formed by using the sub-head 102B and the patterns 202-2 and 202-3 which are formed by using the sub-head 102A is P/2 respectively. In other words, the minimum pitch between patterns formed by the same sub-head is P and the minimum pitch between patterns formed by different sub-heads is P/2. In the chart 200 shown in FIG. 7, P is 6 pixels (127 μm) and P/2 is 3 pixels (63.5 μm).

One half of the difference between the pitch ($Q_1$) between the pattern 202-1 and the pattern 204-1 and the pitch ($Q_2$) between the pattern 204-1 and the pattern 202-2 (namely, $(Q_1-Q_2)/2$) is taken as the amount of step difference Δy between the sub-head 102A and the sub-head 102B. Originally, provided that there are the pattern 202-1 and the pattern 204-1, it is possible to determine the amount of step difference between the sub-head 102A and the sub-head 102B, but if the amount of step difference Δy is determined in this way, then in cases where there is significant displacement of the figure on the recording medium due to expansion or contraction of the recording medium, and the like, the effects of this displacement are suppressed. It is also possible to determine the ratio between $Q_1$ and $Q_2$ ($Q_1/Q_2$) instead of the difference between $Q_1$ and $Q_2$.

In the present embodiment, the same number of patterns (three patterns each) are formed by the sub-head 102A and the sub-head 102B, but the minimum composition of the chart 200 is based on two patterns which are formed by using one sub-head (for example, the sub-head 102A) and one pattern which is formed by using another sub-head (for example, the sub-head 102B). In other words, at least two pitches between patterns formed by different sub-heads should be obtained.

If the chart 200 shown in FIG. 7 is formed, then the pitch $Q_1$ between the pattern 202-1 and the pattern 204-1 and the pitch $Q_2$ between the pattern 204-1 and the pattern 202-2 are measured. In the present embodiment, the measured portion is restricted to a portion 206 where the droplet ejection rate in the pattern 202 of the sub-head 102A and the droplet ejection rate in the pattern 204 of the sub-head 102B are the same (1:1). More specifically, in the pattern 202 and the pattern 204, the portion formed by using nozzles situated substantially in the central portion in the X direction of the overlapping portion 103 is taken as the measurement object, and the portion formed by using the respective ends in the X direction of the overlapping portion 103 (a region having a droplet ejection rate of 1:3 or 3:1) is excluded from the measurement object. Here, the "droplet ejection rate" is expressed by the number of droplets ejected per unit surface area.

Looking in particular at the patterns 202 formed by the sub-head 102A shown in FIG. 6A, the portion 208 where the droplet ejection rate is high (the portion where three pixels are formed continuously with one pixel gaps therebetween), has a relatively small liquid volume per droplet, and therefore the speed of flight of the droplets is relatively slow and the droplets land at positions displaced in the +Y direction from the prescribed depositing positions. On the other hand, the portion 210 where the droplet ejection rate is low (the portion where one pixel is formed with a gap of 3 pixels) has a relatively high liquid volume per droplet and therefore the speed of flight of the droplets is relatively fast and the droplets land in positions displaced in the −Y direction from the prescribed depositing positions. A similar tendency occurs in the patterns 204 which are formed by the sub-head 102B.

Therefore, the pitch between the patterns 202 and the patterns 204 varies in a region which combines a portion where the droplet ejection rate of the patterns 202 is high and a portion where the droplet ejection rate of the patterns 204 is low, or a region which combines a portion where the droplet ejection rate of the patterns 202 is low and a portion where the droplet ejection rate of the patterns 204 is high, and therefore a large amount of error is included in the measurement results. Consequently, it is not possible to obtain an accurate measurement result for the pitch between the patterns 202 and the pattern 204, error arises in the delay time of the ejection timing which is determined by using this measurement results as an input value, and therefore step difference occurs in an overlapping portion between sub-heads.

Consequently, by restricting the measurement object to a region 206 where the droplet ejection rate in the patterns 202 formed by the sub-head 102A and the droplet ejection rate in the patterns 204 formed by the sub-head 102B are the same, it is possible to avoid measurement error caused by difference in the droplet ejection rate, and the accurate pitches $Q_1$ and $Q_2$ between the patterns 202 and the patterns 204 can be determined.

In the patterns 202 which are formed by using the sub-head 102A and the patterns 204 which are formed by using the sub-head 102B, there is a portion where the pixels (dots) are omitted, in accordance with the nozzle arrangement of the overlapping portion 103 (see FIG. 6B). In other words, the regions in the patterns 202 and 204 which are formed by the portion where the nozzle density is the same in the overlapping portion 103 correspond to regions where the droplet ejection density is the same, and therefore, the measurement object is limited to the region 206 of the patterns 202 and 204 which is formed by the region 103B of the overlapping portion 103 where the nozzle density is the same (see FIGS. 6A and 6B).

As described above, in the method of adjusting step difference Δy between sub-heads described in the present embodiment, the pattern pitches $Q_1$, $Q_2$ are measured in the portion 206 where the droplet ejection rate in the patterns 202 and the droplet ejection rate in the patterns 204 are substantially the same as each other. More specifically, in the example shown in FIG. 7, the pattern pitches $Q_1$, $Q_2$ are measured in a portion where the two pixels surrounded by the dotted lines are omitted.

It is enough that the pattern pitches $Q_1$, $Q_2$ between the patterns 202 and the patterns 204 are measurable with submicron accuracy or an accuracy of several microns, and one example of a device for such measurement is MM-400/800 series measurement microscope manufactured by NIKON CORPORATION. Furthermore, it is also possible simply to use a measurement system which combines a CCD camera and a PC, or a measurement system which combines a scanner and a PC. In the present embodiment, the pitch between the patterns 202 and the patterns 204 is measured at two locations, but by using a greater number of measurements, measurement error caused by irregular ejection or irregular measurement results can be suppressed and the measurement accuracy can be improved. Beneficial effects of improving the measurement accuracy are improved quality of the recorded image and reduction in the number of (and labor time required for) step difference adjustments between the sub-heads.

In FIG. 7, three patterns 202, 204 each are formed by using the sub-head 102A and the sub-head 102B, but by increasing the number of patterns, to 5 to around 10 patterns, better beneficial effects can be obtained.

The amount of step difference Δy between the sub-heads determined as described above is stored in a prescribed memory in association with the number of the sub-head ("i" in FIG. 1). The drive unit 133 shown in FIG. 5 (the delay signal generating unit 138) acquires the recording speed (the conveyance speed of the recording medium) as a parameter, and determines the delay time (delay input value) Δt by using a digital value K (digit/time) which is determined on the basis of the time resolution and A/D conversion coefficient (quantized number per unit time), and the recording medium conveyance speed v (mm/s) which is determined from the design value of the conveyance system. The delay time thus determined is stored in a prescribed memory. The delay time Δt (sec) is expressed by $\Delta t=(K\times\Delta y)/v$.

If K=1000000 (digit/time), Δy=0.00635 (mm) and v=635 (mm/s), then the delay time Δt is +10 (digit). In this case, the drive timing of the sub-head which is the object of adjustment is delayed by 10 (digits) with respect to the reference sub-head. If a negative value is calculated as the delay time, then it is necessary to advance the drive timing, but the method of adjusting step difference between sub-heads described in the present embodiment is a method of delaying the drive timing (recording start timing), and therefore blank image data is introduced in the initial portion of the image data of the image to be recorded, and this method is not able to advance the drive timing. Consequently, a certain delay time is set for all of the sub-heads, the sub-head having the shortest drive timing (earliest driving timing) is set as a reference (with a delay time of zero) and the relative delay times of the other sub-heads are set with respect to this reference.

There is an allowable range for the delay time, and therefore the delay time Δt calculated as described above must not exceed the allowable range. More specifically, there are limits on the memory volume which can be allocated to blank image data, and the allowable range (maximum value) of the delay time is specified on the basis of memory volume restrictions. In the present embodiment, the maximum value of the delay time is 0.635 mm when converted to a distance.

Figure 13A:
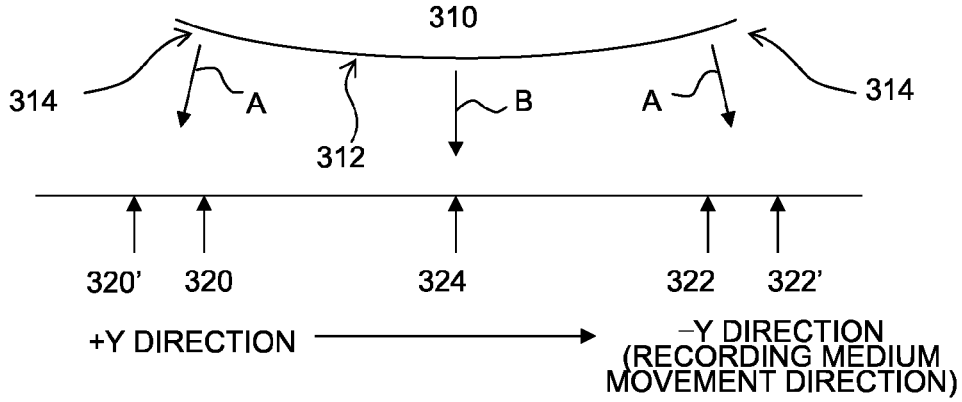
FIG.13A RELATED ART
FIGS. 13A and 13B are diagrams for describing further problems associated with the related art.
Figure 13B:
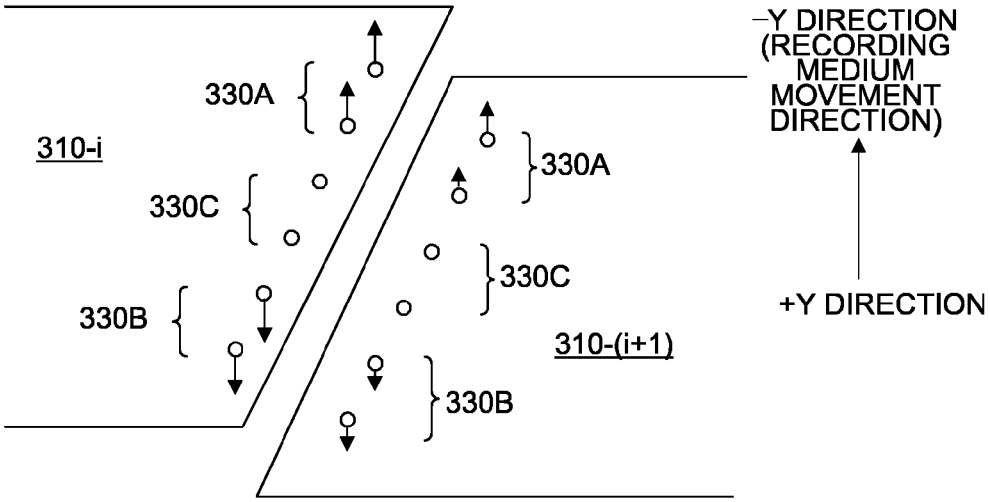
FIG.13B RELATED ART

Furthermore, taking account of the bending of the nozzle surface which is described with reference to FIGS. 13A and 13B, it would be desirable that, in the patterns 202 and 204, a region which is formed by a nozzle positioned in the end portion of the Y direction or by a nozzle positioned in the end portion in the −Y direction, be excluded from the measurement object. In other words, by excluding the regions formed by the nozzle 1081 in the end portion in the −Y direction and the nozzle 108J in the end portion in the +Y direction shown in FIG. 6A, from the measurement object, regions in particular which are liable to be affected by bending of the nozzle surface in the +Y direction and the −Y direction (regions where the linearity of the patterns 202, 204 is poor) are excluded, and it is possible to reduce the effects of bending of the nozzle surface in the measurement results.

Figure 8:
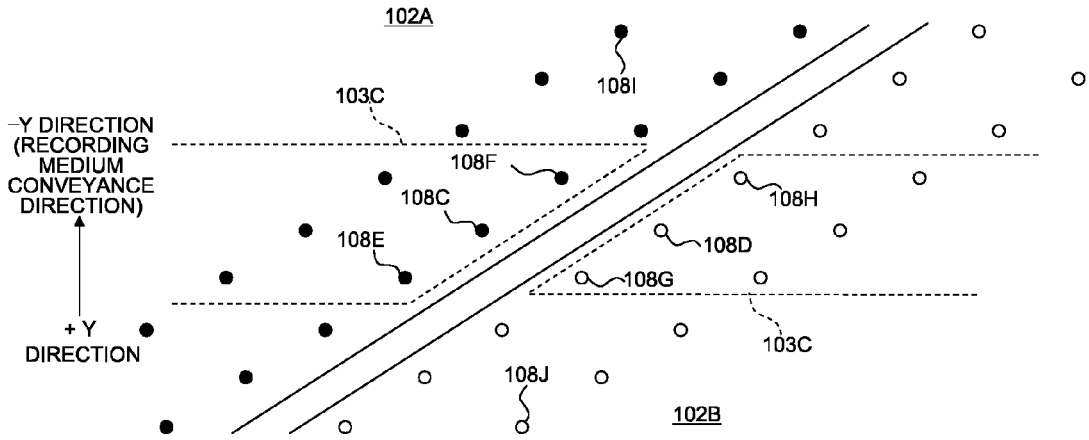
FIG. 8 is a diagram illustrating a central portion in the nozzle arrangement in the Y direction.

Moreover, as shown in FIG. 8, if the measurement object is limited to regions of the patterns 202 and 204 which are formed by using any nozzle belonging to the central portion 103C in the Y direction of the nozzle arrangement of the sub-head 102A and 102B, then the effects of the depositing position error caused by bending of the nozzle surface are further reduced.

Here, the "central portion in the Y direction of the nozzle arrangement" includes the nozzle in the center of the column direction W (see FIG. 3) and both adjacent nozzles on either side of this central nozzle in the column direction W. In the example shown in FIG. 8, the nozzles 108C and 108D are "central nozzles", and the nozzles 108E, 108F, 108G, 108H are "adjacent nozzles on either side of the central nozzle in the column direction W". If the number of nozzles constituting one column is an even number, then there are two "central nozzles", and the four nozzles including the nozzles adjacent to these two nozzles are included in the "central portion in the Y direction of the nozzle arrangement".

In the method of adjusting step difference between sub-heads having the composition described above, of the patterns 202 and 204 in the X direction which constitute a chart formed by each sub-head, a region 206 which is formed by an overlapping portion 103 between sub-heads and in which the droplet ejection rates of the patterns 202 and 204 are substantially the same is taken as the measurement object of the pattern pitches $Q_1$, $Q_2$, and therefore, it is possible to evaluate the amount of step difference Δy between sub-heads accurately, without incorporating depositing position error caused by difference in the droplet ejection rate, into the measurement results. Consequently, the accuracy of the input values (pattern pitch) for calculating the delay time Δt of each sub-head is improved and it is possible to adjust step difference between sub-heads with good accuracy, and the number of adjustments and the labor time required for adjustment can be reduced.

Furthermore, by taking as the measurement object a portion of the patterns 202 and 204 which is formed using nozzles belonging to a central portion 103C which includes a central nozzle in the Y direction of the nozzle arrangement, the effects of depositing position error caused by bending of the nozzle surface are suppressed and the amount of step difference Δy between sub-heads can be evaluated accurately and the adjustment of step difference between the sub-heads can be performed more accurately.

Moreover, by using at least two patterns formed by one sub-head and at least one pattern formed by another sub-head, two or more measurement positions are obtained and the occurrence of measurement error caused by irregular ejection or irregular measurement results can be suppressed, thus improving measurement accuracy.

The nozzle arrangement employed in embodiments of the present invention is not limited to the nozzle arrangement shown in FIGS. 6A and 6B. For example, it is also possible to adopt a composition in which the nozzle arrangement density becomes more sparse, as the nozzle arrangement for the overlapping portion, and in the projected nozzle group shown in FIG. 6B, the ratio between the number of nozzles in the sub-head 102A and the number of nozzles in the sub-head 102B may be 4:1 or 5:1, for example. In this composition, a region formed by a portion where the ratios of the number of nozzles of the sub-head 102A and the sub-head 102B are substantially the same (the difference between the number of nozzles of the sub-head 102A and the number of nozzles of the sub-head 102B is one nozzle or less) is taken as the measurement object. On the other hand, it is also possible to adopt a mode in which a region formed by a portion having the most sparse nozzle arrangement density is excluded from the measurement object.

Next, the specific example of the composition of an apparatus that employs the adjustment of the step differences between the sub-heads described above will be described. The description given below relates to an example of an inkjet recording apparatus which forms a color image on a recording medium by ejecting color inks from nozzles provided in inkjet heads 48M, 48K, 48C and 48Y.

Description of Entire Composition of Inkjet Recording Apparatus

Figure 9:
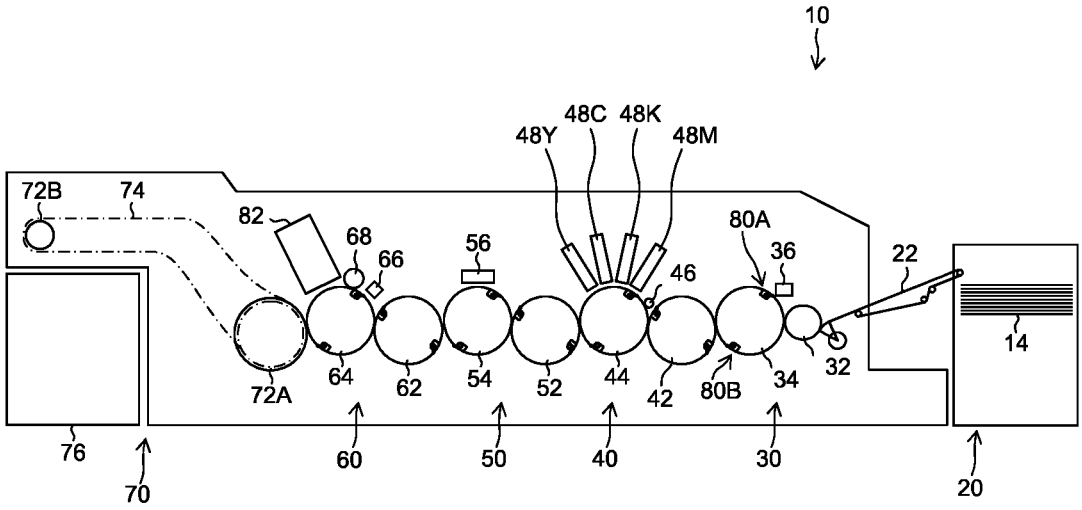
FIG. 9 is a general schematic drawing of an inkjet recording apparatus equipped with an inkjet head to which the adjustment method relating to an embodiment of the present invention is applied.

FIG. 9 is a schematic drawing showing the general composition of an inkjet recording apparatus (image recording apparatus) relating to the present embodiment. The inkjet recording apparatus 10 shown in FIG. 9 is an on-demand type recording apparatus based on a two-liquid aggregation system which forms an image on a recording surface of a recording medium 14 on the basis of prescribed image data, by using ink containing coloring material and an aggregating treatment liquid having a function of aggregating the ink.

The inkjet recording apparatus 10 principally includes a paper feed unit 20, a treatment liquid application unit 30, an image formation unit 40, a drying process unit 50, a fixing process unit 60 and an output unit 70. Transfer drums 32, 42, 52, 62, are provided as devices which receive and transfer a recording medium 14 conveyed respectively from a stage prior to the treatment liquid application unit 30, the image formation unit 40, the drying process unit 50, and the fixing process unit 60, and furthermore, pressure drums 34, 44, 54, 64 having a drum shape are provided as devices for holding and conveying a recording medium 14 respectively in the treatment liquid application unit 30, the image formation unit 40, the drying process unit 50 and the fixing process unit 60.

Grippers 80A and 80B which grip and hold the leading end portion (or the trailing end portion) of the recording medium 14 are provided on the transfer drums 32, 42, 52, 62 and the pressure drums 34, 44, 54, 64. In the gripper 80A and the gripper 80B, a common structure is adopted for gripping and holding the leading end portion of a recording medium 14 and for transferring a recording medium 14 between the grippers provided in the other pressure drums or transfer drums; furthermore, the gripper 80A and the gripper 80B are disposed in symmetrical positions separated by 180° in the direction of rotation of the pressure drum 34 on the outer circumferential surface of the pressure drum 34.

When the transfer drums 32, 42, 52, 62 and the pressure drums 34, 44, 54, 64 which are gripping the leading end portion of a recording medium 14 by means of the grippers 80A and 80B rotate in prescribed directions, the recording medium 14 is rotated and conveyed following the outer circumferential surface of the transfer drums 32, 42, 52, 62 and the pressure drums 34, 44, 54, 64.

In FIG. 9, only the reference numerals of the grippers 80A and 80B provided on the pressure drum 34 are indicated, and the reference numerals of the grippers on the other pressure drums and transfer drums are not shown.

When recording medium (cut sheet paper) 14 accommodated in the paper feed unit 20 is supplied to the treatment liquid application unit 30, an aggregating treatment liquid (hereinafter, simply referred to as "treatment liquid") is applied to the recording surface of the recording medium 14 held on the outer circumferential surface of the pressure drum 34. The "recording surface of the recording medium 14" is the outer surface when the medium is held by the pressure drums 34, 44, 54, 64, this being the surface opposite to the surface held on the pressure drums 34, 44, 54, 64.

Thereupon, the recording medium 14 on which the aggregating treatment liquid has been deposited is output to the image formation unit 40 and colored ink is deposited by the image formation unit 40 onto the area of the recording surface where the aggregating treatment liquid has been deposited, thereby forming a desired image.

Moreover, a recording medium 14 on which an image has been formed by the colored inks is sent to the drying process unit 50, and a drying process is carried out by the drying process unit 50, in addition to which the medium is conveyed to the fixing process unit 60 after the drying process and a fixing process is carried out. By carrying out the drying process and the fixing process, the image formed on the recording medium 14 is made durable. In this way, a desired image is formed on the recording surface of the recording medium 14 and after fixing the image on the recording surface of the recording medium 14, the medium is conveyed to the exterior of the apparatus from the output unit 70.

Respective units of the inkjet recording apparatus 10 (paper feed unit 20, treatment liquid application unit 30, image formation unit 40, drying process unit 50, fixing process unit 60 and output unit 70) are described in detail below.

Paper Supply Unit

The paper feed unit 20 includes a paper feed tray 22 and a paying out mechanism (not illustrated) and is composed so as to pay out the recording medium 14 one sheet at a time from the paper feed tray 22. The recording medium 14 paid out from the paper feed tray 22 is registered in position by a guide member (not illustrated) and halted temporarily in such a manner that the leading end portion is disposed at the position of the gripper (not illustrated) on the transfer drum (paper feed drum) 32.

Treatment Liquid Application Unit

The treatment liquid application unit 30 includes a pressure drum (treatment liquid drum) 34 which holds, on the outer circumferential surface thereof, a recording medium 14 transferred from the paper feed drum 32 and conveys the recording medium 14 in the prescribed conveyance direction, and a treatment liquid application apparatus 36 which applies treatment liquid to the recording surface of a recording medium 14 held on the outer circumferential surface of the treatment liquid drum 34. When the treatment liquid drum 34 is rotated in the counter-clockwise direction in FIG. 9, the recording medium 14 is conveyed so as to rotate in the counter-clockwise direction following the outer circumferential surface of the treatment liquid drum 34.

The treatment liquid application apparatus 36 shown in FIG. 9 is provided at a position facing the outer circumferential surface (recording medium holding surface) of the treatment liquid drum 34. One example of the composition of the treatment liquid application apparatus 36 is a mode which includes a treatment liquid vessel which stores treatment liquid, an uptake roller which is partially immersed in the treatment liquid in the treatment liquid vessel and which takes up the treatment liquid in the treatment liquid vessel, and an application roller (rubber roller) which moves the treatment liquid taken up by the uptake roller to the recording medium 14.

A desirable mode is one which includes an application roller movement mechanism which moves the application roller in the upward and downward direction (the normal direction with respect to the outer circumferential surface of the treatment liquid drum 34), so as to be able to avoid collisions between the application roller and the grippers 80A and 80B.

The treatment liquid deposited on the recording medium 14 by the treatment liquid application unit 30 contains a coloring material aggregating agent which aggregates the coloring material (pigment) in the ink deposited by the image formation unit 40, and when the treatment liquid and the ink come into contact with each other on the recording medium 14, the separation of the coloring material and the solvent in the ink is promoted.

Desirably, the treatment liquid application apparatus 36 applies the treatment liquid while dosing the amount of treatment liquid applied to the recording medium 14, and desirably, the thickness of the film of treatment liquid on the recording medium 14 is sufficiently smaller than the diameter of the ink droplets which are ejected from the image formation unit 40.

Image Formation Unit

The image formation unit 40 includes a pressure drum (image formation drum) 44 which holds and conveys a recording medium 14, a paper pressing roller 46 for causing the recording medium 14 to adhere tightly to the image formation drum 44, and inkjet heads 48M, 48K, 48C and 48Y which deposit ink onto the recording medium 14. The basic structure of the image formation drum 44 is the same as that of the treatment liquid drum 34, which is described above, and the detailed explanation is omitted here.

The paper pressing roller 46 is a guide member for causing the recording medium 14 to make tight contact with the outer circumferential surface of the image formation drum 44, and is disposed facing the outer circumferential surface of the image formation drum 44, to the downstream side, in terms of the conveyance direction of the recording medium 14, of the transfer position of the recording medium 14 between the transfer drum 42 and the image formation drum 44 and to the upstream side, in terms of the conveyance direction of the recording medium 14, of the inkjet heads 48M, 48K, 48C and 48Y.

When the recording medium 14 which has been transferred from the transfer drum 42 to the image formation drum 44 is conveyed to rotate in a state where the leading end is held by a gripper (reference numeral not indicated), the recording medium is pressed by the paper pressing roller 46 and is caused to make tight contact with the outer circumferential surface of the image formation drum 44. After the recording medium 14 has been caused to make tight contact with the outer circumferential surface of the image formation drum 44 in this way, the recording medium 14 is passed to a printing region directly below the inkjet heads 48M, 48K, 48C and 48Y, without any floating up of the medium from the outer circumferential surface of the image formation drum 44.

The inkjet heads 48M, 48K, 48C and 48Y respectively correspond to inks of the four colors of magenta (M), black (K), cyan (C) and yellow (Y), and are disposed in this order from the upstream side in terms of the direction of rotation of the image formation drum 44 (the counter-clockwise direction in FIG. 9), in addition to which the ink ejection surfaces of the inkjet heads 48M, 48K, 48C and 48Y (the nozzle surfaces, indicated by reference numeral 114A in FIG. 5) are disposed so as to face the recording surface of the recording medium 14 which is held on the image formation drum 44. Here, the "ink ejection surfaces (nozzle surfaces)" are surfaces of the inkjet heads 48M, 48K, 48C and 48Y which face the recording surface of the recording medium 14, and are the surfaces where the nozzles which eject ink as described below are formed (these nozzles are indicated by reference numeral 108 in FIG. 4).

Furthermore, the inkjet heads 48M, 48K, 48C and 48Y shown in FIG. 9 are disposed at an inclination with respect to the horizontal plane, in such a manner that the recording surface of the recording medium 14 which is held on the outer circumferential surface of the image formation drum 44 and the nozzle surfaces of the inkjet heads 48M, 48K, 48C and 48M are substantially parallel.

The inkjet heads 48M, 48K, 48C and 48Y are full line heads having a length corresponding to the maximum width of the image forming region on the recording medium 14 (the length of the recording medium 14 in the direction perpendicular to the conveyance direction), and each are fixed so as to extend in a direction perpendicular to the conveyance direction of the recording medium 14.

Nozzles for ejecting ink are formed on the nozzle surfaces of the inkjet heads 48M, 48K, 48C and 48Y, in a matrix configuration throughout the whole width of the image forming region of the recording medium 14.

When the recording medium 14 is conveyed to the printing region directly below the inkjet heads 48M, 48K, 48C and 48Y, inks of respective colors are ejected (as droplets) on the basis of image data, from the inkjet heads 48M, 48K, 48C and 48Y onto the region of the recording medium 14 where an aggregating treatment liquid has been deposited.

When the droplets of the corresponding colored inks are ejected from the inkjet heads 48M, 48K, 48C and 48Y toward the recording surface of the recording medium 14 held on the outer circumferential surface of the image formation drum 44, the ink makes contact with the treatment liquid on the recording medium 14, and an aggregating reaction occurs with a coloring material (pigment-based coloring material) which is dispersed in the ink or a coloring material (dye-based coloring material) which can be insolubilized, thereby forming an aggregate of the coloring material. By this means, movement of the coloring material in the image formed on the recording medium 14 (positional displacement of the dots, color non-uniformities of the dots) is prevented.

Furthermore, the image formation drum 44 of the image formation unit 40 is structurally separate from the treatment liquid drum 34 of the treatment liquid application unit 30, and therefore treatment liquid is never applied to the inkjet heads 48M, 48K, 48C and 48Y, and it is possible to reduce the causes of ink ejection abnormalities.

Although a configuration with the four standard colors of C, M, Y and K is described in the present embodiment, the combinations of the ink colors and the number of colors are not limited to these. Light inks, dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

Drying Process Unit

The drying process unit 50 includes a pressure drum (drying drum) 54 which holds and conveys a recording medium 14 after image formation, and a solvent drying apparatus 56 which carries out a drying process for evaporating off the water content (liquid component) on the recording medium 14. The basic structure of the drying drum 54 is the same as the treatment liquid drum 34 and the image formation drum 44 which are described above, and the detailed explanation is omitted here.

The solvent drying apparatus 56 is a processing unit which is disposed in a position facing the outer circumferential surface of the drying drum 54 and evaporates off the water content present on the recording medium 14. If the ink is deposited on the recording medium 14 by the image formation unit 40, then the liquid component of the ink (solvent component) and the liquid component of the treatment liquid (solvent component) which have been separated by the aggregating reaction between the treatment liquid and the ink remain on the recording medium 14, and therefore it is necessary to remove this liquid component.

The solvent drying apparatus 56 is a processing unit which carries out a drying process by evaporating off the liquid component present on the recording medium 14, through heating by a heater, or air blowing by a fan, or a combination of these, in order to remove the liquid component on the recording medium 14. The amount of heating and the air flow volume applied to the recording medium 14 are set appropriately in accordance with parameters, such as the amount of water remaining on the recording medium 14, the type of recording medium 14, the conveyance speed of the recording medium 14 (interference processing time), and the like.

The drying drum 54 of the drying process unit 50 is structurally separate from the image formation drum 44 of the image formation unit 40; therefore, when a drying process is carried out by the solvent drying unit 56, it is possible to reduce the causes of ink ejection abnormalities due to drying of the head meniscus portions in the inkjet heads 48M, 48K, 48C and 48Y as a result of the applied heat or air flow.

In order to display an effect in correcting cockling of the recording medium 14, the curvature of the drying drum 54 is desirably 0.002 (1/mm) or greater. Furthermore, in order to prevent curving (curling) of the recording medium after the drying process, the curvature of the drying drum 54 is desirably 0.0033 (1/mm) or less.

Moreover, desirably, a device for adjusting the surface temperature of the drying drum 54 (for example, an internal heater) may be provided to adjust the surface temperature to 50° C. or above. Drying is promoted by carrying out a heating process from the rear surface of the recording medium 14, thereby preventing destruction of the image in the subsequent fixing process. According to this mode, more beneficial effects are obtained if a device for causing the recording medium 14 to adhere tightly to the outer circumferential surface of the drying drum 54 is provided. Possible examples of a device for causing tight adherence of the recording medium 14 include a vacuum suctioning device and electrostatic attraction device, and the like.

There are no particular restrictions on the upper limit of the surface temperature of the drying drum 54, but from the viewpoint of the safety of maintenance operations such as cleaning the ink adhering to the surface of the drying drum 54 (preventing burns due to high temperature), desirably, the surface temperature of the drying drum 54 is equal to or lower than 75° C. (and more desirably, equal to or lower than 60° C.).

By holding the recording medium 14 in such a manner that the recording surface thereof is facing outwards on the outer circumferential surface of the drying drum 54 having this composition (in other words, in a state where the recording surface of the recording medium 14 is curved in a convex shape), and carrying out a drying process while conveying the recording medium in rotation, it is possible reliably to prevent drying non-uniformities caused by wrinkling or floating up of the recording medium 14.

Fixing Process Unit

The fixing process unit 60 includes a pressure drum (fixing drum) 64 which holds and conveys a recording medium 14, a heater 66 which carries out a heating process on the recording medium 14 on which an image has been formed and from which liquid has been removed, and a fixing roller 68 which pressurizes the recording medium 14 from the recording surface side. The basic structure of the fixing drum 64 is common to that of the treatment liquid drum 34, the image formation drum 44 and the drying drum 54, and description thereof is omitted here.

In the fixing process unit 60, a preliminary heating process by means of the heater 66 is carried out on the recording surface of the recording medium 14, and a fixing process by means of the fixing roller 68 is also carried out. The heating temperature of the heater 66 is set appropriately in accordance with the type of the recording medium, the type of ink (the type of polymer micro-particles contained in the ink), and the like. For example, a possible mode is one where the heating temperature is set to the glass transition temperature or the minimum film forming temperature of the polymer micro-particles contained in the ink.

The fixing roller 68 is a roller member for melting self-dispersing polymer micro-particles contained in the ink and thereby causing the ink to form a film, by applying heat and pressure to the dried ink, and is composed so as to heat and pressurize the recording medium 14. More specifically, the fixing roller 68 is disposed so as to press against the fixing drum 64, in such a manner that the fixing roller 68 serves as a nip roller with the fixing drum 64. By this means, the recording medium 14 is sandwiched between the fixing roller 68 and the fixing drum 64 and is nipped with a prescribed nip pressure, whereby a fixing process is carried out.

An example of the composition of the fixing roller 68 is a mode where the roller is constituted by a heating roller which incorporates a halogen lamp inside a metal pipe made of aluminum, or the like, having good heat conductivity. If heat energy at or above the glass transition temperature of the polymer micro-particles contained in the ink is applied by heating the recording medium 14 by means of this heating roller, then the polymer micro-particles melt and a transparent film is formed on the surface of the image.

By applying pressure to the recording surface of the recording medium 14 in this state, the polymer micro-particles which have melted into the undulations in the recording medium 14 are pressed and fixed, and the undulations in the image surface are thereby leveled out, thus making it possible to obtain a desirable luster. A desirable composition is one where fixing rollers 68 are provided in a plurality of stages respectively, in accordance with the thickness of the image layer and the glass transition temperature characteristics of the polymer micro-particles.

Furthermore, desirably, the surface hardness of the fixing roller 68 is equal to or less than 71°. By further softening the surface of the fixing roller 68, it is possible to expect effects in following the undulations of the recording medium 14 which are produced by cockling, and fixing non-uniformities caused by such undulations of the recording medium 14 are prevented more effectively.

The inkjet recording apparatus 10 shown in FIG. 9 includes an in-line sensor 82 which is provided at a latter stage of the processing region of the fixing process unit 60 (on the downstream side in terms of the direction of conveyance of the recording medium). The in-line sensor 82 is a sensor for reading an image formed on the recording medium 14 (or a test pattern formed in the margin area of the recording medium 14), and desirably employs a CCD line sensor.

In the inkjet recording apparatus 10 shown in the present embodiment, the presence or absence of ejection abnormalities in the inkjet heads 48M, 48K, 48C and 48Y is judged on the basis of the reading results of the in-line sensor 82. Furthermore, the in-line sensor 82 may include a measurement device for measuring the water content, surface temperature, luster, and the like. According to this mode, parameters, such as the processing temperature of the drying process unit 50 and the heating temperature and applied pressure of the fixing process unit 60, are adjusted appropriately on the basis of the read results for the water content, surface temperature and the luster, and the above-described control parameters are appropriately adjusted according to the change in temperature inside the apparatus and the change in temperature of the respective parts.

Output Unit

As shown in FIG. 9, the output unit 70 is provided subsequently to the fixing process unit 60. The output unit 70 includes an endless conveyance belt 74 wrapped about tensioning rollers 72A and 72B, and an output tray 76 in which a recording medium 14 after image formation is accommodated.

The recording medium 14 which has undergone the fixing process and which is output from the fixing process unit 60 is conveyed by the conveyance belt 74 and output to the output tray 76.

The inkjet recording apparatus 10 shown in FIG. 9 is equipped with inkjet heads as described with reference to FIGS. 1 to 4, for each respective color.

Control System

Figure 10:
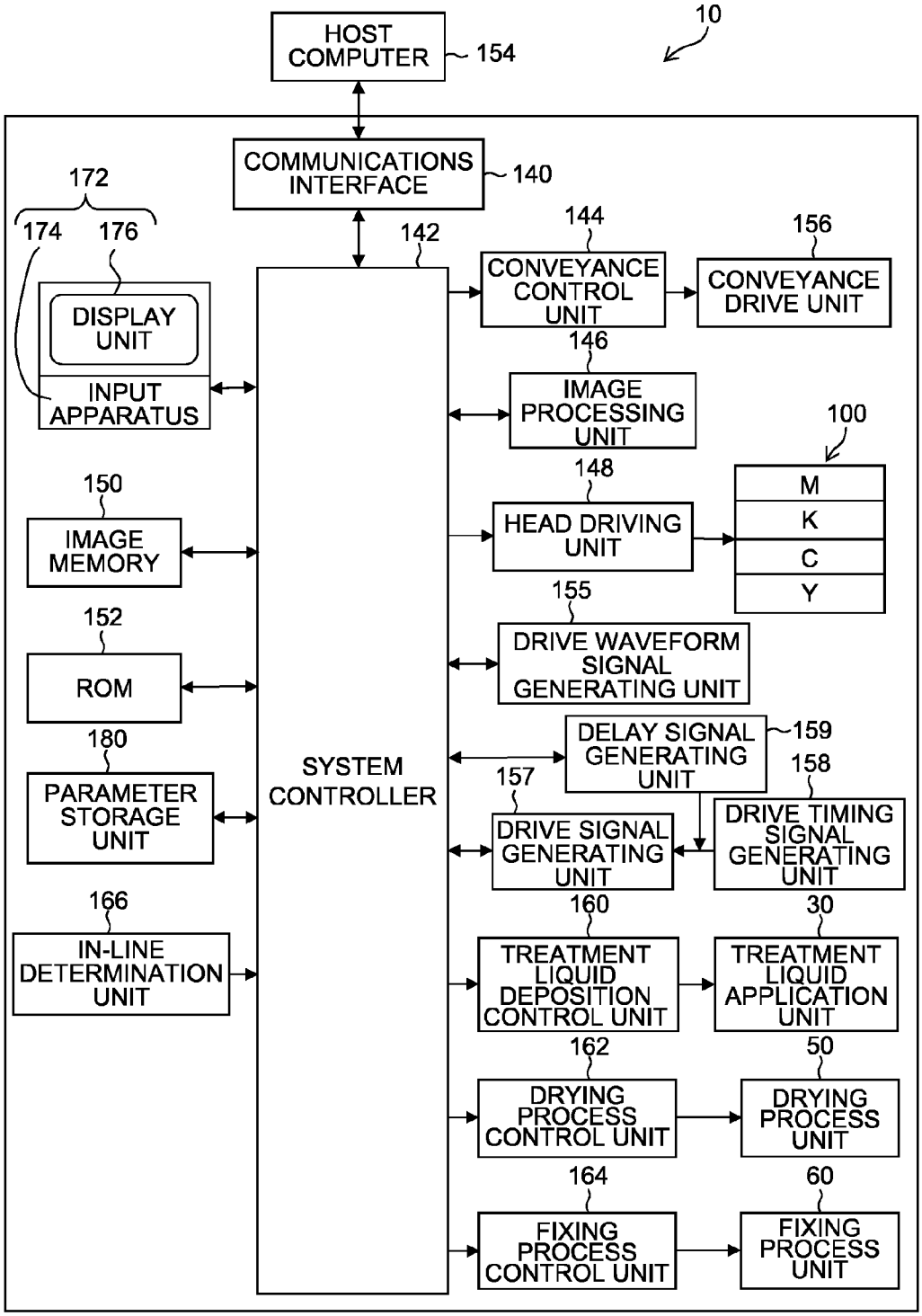
FIG. 10 is a block diagram showing an example of the composition of a control system of the inkjet recording apparatus shown in FIG. 9.
Figure 11:
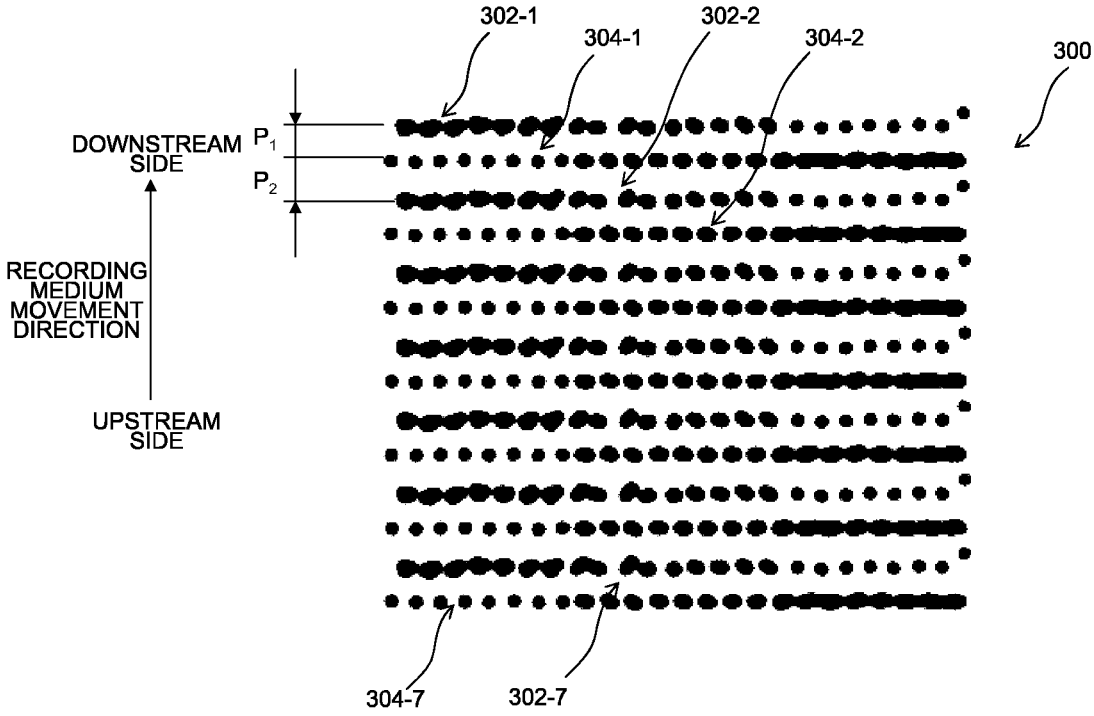
FIG.11 RELATED ART
FIG. 11 is a diagram for describing problems associated with the related art.
Figure 12:
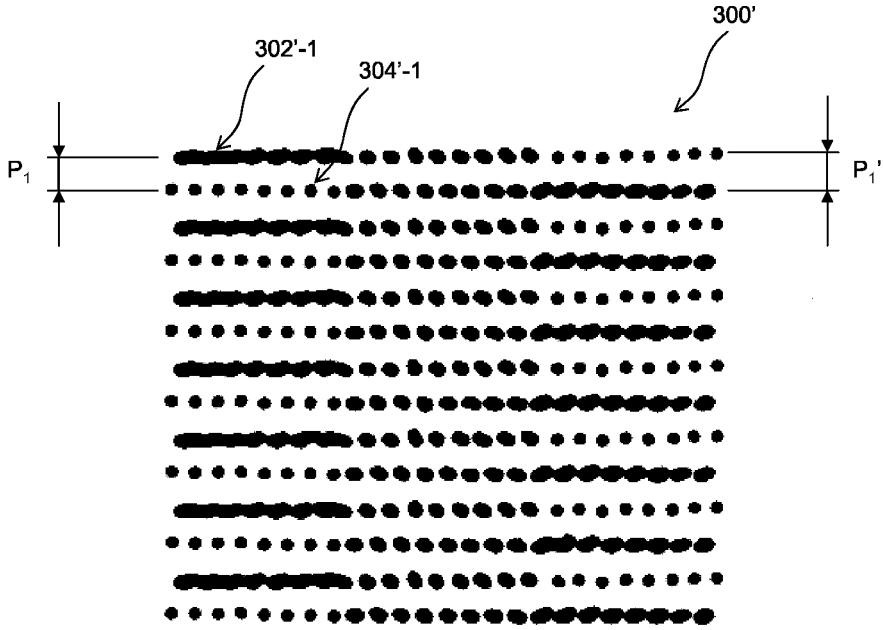
FIG.12 RELATED ART
FIG. 12 is a diagram for describing problems associated with the related art.

FIG. 10 is a block diagram showing a system composition of the inkjet recording apparatus 10. As shown in FIG. 10, the inkjet recording apparatus 10 includes a communications interface 140, a system controller 142, a conveyance control unit 144, an image processing unit 146, and a head driving unit 148, as well as an image memory 150, a ROM 152, and the like.

The communications interface 140 is an interface unit for receiving image data which is transmitted by a host computer 154. The communications interface 140 may employ a serial interface, such as a USB (Universal Serial Bus), or a parallel interface, such as a Centronics device. It is also possible to install a buffer memory (not illustrated) for achieving high-speed communications in the communications interface 140.

The system controller 142 is constituted by a central processing unit (CPU) and peripheral circuits of same, and the like, and functions as a control apparatus which controls the whole of the inkjet recording apparatus 10 in accordance with prescribed programs, as well as functioning as a calculating apparatus which performs various calculations and also functioning as a memory controller for the image memory 150 and the ROM 152. In other words, the system controller 142 controls the various sections, such as the communications interface 140, the conveyance control unit 144, and the like, as well as controlling communications with the host computer 154 and reading and writing of data to and from the image memory 150 and the ROM 152, and the like, and generating control signals for controlling the respective units described above.

Image data sent from the host computer 154 is read into the inkjet recording apparatus 10 via the communications interface 140, and is stored temporarily in the image memory 150. The image memory 150 is a storage device which stores an image input via the communications interface 140, and data is read from and written to this memory via the system controller 142. The image memory 150 is not limited to a memory made from semiconductor element, and may also employ a magnetic medium, such as a hard disk.

The conveyance control unit 144 controls the conveyance timing and conveyance speed of a recording medium 14 (see FIG. 9) on the basis of a print control signal generated by the image processing unit 146. The conveyance drive unit 156 in FIG. 10 includes motors which rotate the pressure drums 34 to 64 shown in FIG. 9, motors which rotate the transfer drums 32 to 62, a motor of the conveyance mechanism of the recording medium 14 in the paper supply unit 20, a motor which drives the tensioning roller 72A (72B) of the output unit 70, and the like, and the conveyance control unit 144 functions as a driver of the motors described above.

The image processing unit 146 is a control unit which reads out image data stored in the image memory 150 and also has signal (image) processing functions for carrying out various treatments, corrections and other processing in order to generate a signal for controlling printing from the image data, as well as supplying the generated print data to the head driving unit 148. Required signal processing is carried out in the image processing unit 146 and the ejected droplet volume (droplet ejection volume) and the ejection timing of the head 100 are controlled via the head driving unit 148 on the basis of the image data. By this means, a desired dot size and a dot arrangement are achieved. The head driving unit 148 shown in FIG. 10 may also include a feedback control system for maintaining uniform drive conditions in the head 100.

The image memory 150 is used as a temporary storage area for image data and also serves as a development area for programs and a calculation work area for the CPU.

Programs to be executed by the CPU of the system controller 142 and various types of data required for control purposes (data for ejecting droplets to form a test chart, waveform data for detecting abnormal nozzles, waveform data for image recording, abnormal nozzle information, and the like) are stored in the ROM 152. The ROM 152 may be a non-rewriteable storage device, or may be a rewriteable storage device such as an EEPROM.

To give a general description of the processing from image input to print output, the image data that is to be printed is input via the communications interface 140 from an external source and is collected in the image memory 150. At this stage, for example, RGB multiple-value image data is stored in the image memory 150.

In the inkjet recording apparatus 10, an image having tones which appear continuous to the human eye is formed by altering the droplet ejection density and dot size of fine dots of ink (coloring material), and therefore it is necessary to convert the tones of the input digital image (light/dark (thickness) density of the image) into a dot pattern which reproduces the tones as faithfully as possible. Therefore, original image (RGB) data stored in the image memory 150 is sent to the image processing unit 146 via the system controller 142 and is converted into dot data of the respective ink colors by processes of density data generation, correction processing, and ink ejection data generation.

In other words, the image processing unit 146 carries out processing for converting the input RGB image data into dot data for the four colors of M, K, C and Y. The dot data generated by the image processing unit 146 in this way is stored in an image buffer memory, which is not illustrated. This color-specific dot data is converted into MKCY droplet ejection data for ejecting inks from the nozzles of the head 100, thereby establishing ink ejection data which is to be printed.

By applying a drive waveform output from the head driving unit 148 to the head 100 in this way, ink is ejected from the corresponding nozzles 108. An image is formed on a recording medium 14 by controlling ink ejection from the head 100 in synchronism with the conveyance speed of the recording medium 14.

The drive waveform signal generating unit 155 shown in FIG. 10 is a block which generates a drive waveform having a drive waveform signal included in the drive waveform signal generating unit 135 shown in FIG. 5. The current and voltage of the drive waveform read out from the drive waveform signal generating unit 155 are amplified in the head driving unit 148, and the drive waveform is then supplied to the head 100 as a drive waveform signal. Furthermore, the drive signal generating unit 157, the drive timing signal generating unit 158 and the delay signal generating unit 159 correspond respectively to the drive signal generating unit 136, the drive timing signal generating unit 137 and the delay signal generating unit 138 shown in FIG. 5. These blocks operate in accordance with instructions from the system controller 142.

Furthermore, the inkjet recording apparatus 10 includes a treatment liquid deposition control unit 160, a drying process control unit 162 and a fixing process control unit 164, which respectively control the operation of the treatment liquid application unit 30, the drying process unit 50 and the fixing process unit 60 in accordance with instructions from the system controller 142.

The treatment liquid deposition control unit 160 controls the timing of treatment liquid application, as well as controlling the amount of treatment liquid applied, on the basis of print data obtained from the image processing unit 146. Furthermore, the drying process control unit 162 controls the timing of the drying process, as well as controlling the process temperature, air flow volume, and the like, and the fixing process control unit 164 controls the temperature of the heater 66 of the fixing process unit 60, as well as the application pressure of the fixing roller 68.

The in-line determination unit 166 is a processing block which includes the in-line sensor 82 as shown in FIG. 9, and a signal processing unit for carrying out prescribed signal processing, such as noise removal, amplification, waveform shaping, and the like, of the read signal output from the in-line sensor 82. The system controller 142 judges the presence or absence of ejection abnormalities in the head 100 on the basis of the determination signal obtained by the in-line determination unit 166.

More specifically, the system controller 142 supplies read data of the test chart and the depositing position evaluation pattern read in from the in-line determination unit 166, to the judgment unit. The judgment unit judges whether or not there is an abnormality in each respective nozzle, by ascertaining the depositing position error, the dot size error and the density error, and the like, on the basis of the read data. This processing function can be achieved by an ASIC, software, or a suitable combination thereof. The information (data) about ejection abnormality nozzles determined by the judgment unit 168 is stored in a prescribed memory. For example, it is possible to adopt a composition in which the ROM 152 also serves as a memory for storing information about ejection abnormality nozzles, by utilizing the storage area of the ROM 152.

A nozzle judged to have an abnormality (an ejection abnormality nozzle which cannot perform normal ejection) is disabled by implementing a masking (disabling) process, and image formation by a masked (mask-processed) nozzle is performed instead by another nozzle(s). Furthermore, if the number of nozzles which have been masked or the distribution of nozzles which have been masked exceeds a prescribed reference, then the system controller 142 sends an instruction signal to respective units in such a manner that maintenance of the head 100 is carried out. Maintenance of the head 100 includes processes such as wiping the nozzle surface 114A (see FIG. 5), suctioning the nozzles, and so on. Moreover, if it is not possible to restore prescribed performance even after carrying out processes such as wiping and nozzle suctioning, then a report indicating the need for maintenance by a service technician (technical call out) or a report indicating the need for head replacement is issued.

The in-line sensor 82 mounted in the inkjet recording apparatus 10 shown in the present embodiment performs reading at a lower resolution than the recording resolution of the inkjet head 48. For example, whereas the recording resolution of the head 100 is 2400 dpi, the reading resolution of the in-line sensor 82 is approximately 400 to 600 dpi. The in-line sensor 82 may be composed in such a manner that the entire width of the image formation region on the recording medium 14 is read in by enlarging, via an enlarging optics system, a reading range which smaller than the entire width of the image formation region on the recording medium. Furthermore, the sensor may also be constituted by a plurality of image sensors.

The user interface 172 is constituted by an input apparatus 174 for the operator (user) to make various inputs and a display unit (display) 176. The input apparatus 174 may employ various modes, such as a keyboard, mouse, touch panel, buttons, or the like. By operating the input apparatus 174, an operator can perform actions such as inputting print conditions, selecting the image quality mode, inputting and editing additional information, searching for information, and the like, and can confirm various information such as input content, search results, and the like, via the display on the display unit 176. This display unit 176 also functions as a device which displays warnings, such as error messages.

The parameter storage unit 180 stores various control parameters which are necessary for the operation of the inkjet recording apparatus 10. The system controller 142 reads out parameters required for control purposes, as appropriate, and updates (rewrites) parameters as and where necessary.

Example of Application to Other Apparatuses

In the embodiments described above, application to an inkjet recording apparatus for graphic printing is described, but the scope of application of the present invention is not limited to this example. For example, the present invention can also be applied widely to inkjet systems which obtain various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

Furthermore, in the embodiments described above, an image recording apparatus which employs an inkjet method is given as an example, but the present invention can also be applied to an electrophotographic type of image recording apparatus. For example, it is possible to use recording elements including light-emitting elements, such as LED elements, instead of liquid ejecting elements including nozzles based on an inkjet system.

APPENDIX

As has become evident from the detailed description of the embodiments given above, the present specification includes disclosure of various technical ideas including the inventions described below.

One aspect of the present invention is directed to a recording head adjustment method comprising: a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement; a step-difference amount calculation step of measuring positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtaining an amount of step difference between the sub-heads represented by difference or ratio of the measured positions in the direction of the relative movement of the dot rows for the respective sub-heads; an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value.

According to this aspect of the invention, when measuring the positions of dot rows formed by respective sub-heads, a region where the recording rates are substantially the same as each other, of the portion formed by the overlapping portion between sub-heads, is taken as a measurement object, and therefore it is possible to reduce error in the measurement results and the step difference between sub-heads can be measured with good accuracy.

In a mode where three or more sub-heads are joined together, it is desirable that one sub-head should be taken as reference and the step difference of the other two sub-heads should be determined with respect to this reference sub-head. In a mode of this kind, it is desirable that a composition should be adopted in which the sub-head which is located in a position furthest to the rearward side in the direction of the relative movement is used as the reference sub-head and the drive timing of the other sub-heads is delayed with respect to the reference sub-head.

A desirable mode is one including an amount of step difference storage step of storing the amount of step difference calculated by the step-difference amount calculation step. Furthermore, a desirable mode is one where, in the adjustment value calculation step, an adjustment value is calculated by reading out an amount of step difference stored in the memory.

Desirably, in the dot row forming step, a plurality of first dot rows in the direction substantially perpendicular to the direction of the relative movement are formed at a prescribed arrangement interval in the direction of the relative movement by using one sub-head of the mutually adjacent sub-heads, and a second dot row in the direction substantially perpendicular to the direction of the relative movement is formed between the plurality of first dot rows by using the other sub-head of the mutually adjacent sub-heads, and in the step-difference amount calculation step, the amount of step difference between the mutually adjacent sub-heads is calculated according to measurement result of measuring pitches between the plurality of first dot rows and the second dot row.

According to this aspect of the invention, by forming at least two first dot rows using one sub-head and also forming a second dot row between the first dot rows using another sub-head, it is possible to create a plurality of measurement positions, and desirable measurement which excludes irregular dot formation or irregular measurement results is performed.

A desirable mode is one where, in the dot row forming step, the first and second dot rows are formed in such a manner that the pitches between the first dot rows and the second dot row are equal.

Desirably, in the dot row forming step, the dot rows are formed in such a manner that a dot forming portion where a dot is formed and a dot omission portion where a dot is omitted are included in the dot rows formed by using the overlapping portion and in such a manner that the dot forming portion of the dot row formed by one sub-head of the mutually adjacent sub-heads corresponds to a position, in the direction of the relative movement, of the dot omission portion of the dot row formed by the other sub-head of the mutually adjacent sub-heads.

For example, one example of dot rows formed by the one sub-head is constituted by a one-dot dot omission portion, a three-dot dot forming portion, a two-dot dot omission portion, a two-dot dot forming portion, a three-dot dot omission portion, and a one-dot dot forming portion. If a dot row formed by one sub-head has the composition described above, then a dot row formed by the other sub-head is constituted by a three-dot dot omission portion, a one-dot dot forming portion, a two-dot dot omission portion, a two-dot dot forming portion, a one-dot dot omission portion, and a three-dot dot forming portion.

Desirably, in the step-difference amount calculation step, the positions in the direction of the relative movement of the dot rows formed by the respective sub-heads are measured by taking, as the measurement object, a region formed by using the recording elements belonging to a central portion including the central recording element in the direction of the relative movement, of the dot rows formed by the overlapping portion.

According to this aspect of the invention, even if the surface where the recording elements are arranged is bent in the direction of the relative movement of the recording medium, it is possible to suppress error in the dot row forming positions in this direction, and therefore desirable measurement can be performed.

Desirably, the positions in the direction of the relative movement of the dot rows formed by the respective sub-heads are measured by excluding, from the measurement object, regions formed by using the recording elements in both end portions in the direction of the relative movement, of the dot rows formed by the overlapping portion.

According to this aspect of the invention, by excluding, from the measurement object, regions which are formed by recording elements in the end portions in terms of the direction of the relative movement and which are especially liable to be affected by bending of the recording element arrangement surface in the direction of the relative movement of the recording medium, it is possible to suppress error in the dot row forming positions in the direction of the relative movement, and thus perform desirable measurement.

Another aspect of the present invention is directed to a recording head adjustment method comprising: a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement; a step-difference amount calculation step of measuring positions in the direction of the relative movement of the dot rows formed by the respective sub-heads are measured by taking, as a measurement object, a region formed by using the recording elements belonging to a central portion including the central recording element in the direction of the relative movement, and obtaining an amount of step difference between the sub-heads represented by difference or ratio of the measured positions in the direction of the relative movement of the dot rows for the respective sub-heads; an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value.

According to this aspect of the invention, a desirable mode is one where, in the dot row forming step, at least two first dot rows in a direction substantially perpendicular to the direction of the relative movement are formed at a prescribed arrangement interval in the direction of the relative movement by using one sub-head of mutually adjacent sub-heads, and a second dot row in a direction substantially perpendicular to the direction of the relative movement is formed between the first dot rows by using the other sub-head of the mutually adjacent sub-heads, and in the step-difference amount calculation step, the amount of step difference between the one sub-head and the other sub-head is calculated on the basis of a result of measuring pitches between the first dot rows and the second dot row.

Furthermore, a desirable mode is one where, in the dot row forming step, respective dot rows are formed so as to include a dot forming portion where a dot is formed and a dot omission portion where a dot is omitted in the dot rows formed by using the overlapping portion, and respective dots are formed in such a manner that a dot forming portion of a dot row formed by one sub-head of mutually adjacent sub-heads corresponds to a position, in the direction of the relative movement, of a dot omission portion of a dot row formed by the other sub-head of the mutually adjacent sub-heads.

Another aspect of the invention is directed to an image recording apparatus comprising: a recording head having a structure in which a plurality of sub-heads each including a plurality of recording elements are joined together; a recording head drive device which causes relative movement between a recording medium and the recording head and drives the plurality of recording elements at prescribed drive timing with respect to each of the plurality of sub-heads; a drive control device which controls the recording head drive device to form dot rows for the respective sub-heads, the dot rows extending in a direction substantially perpendicular to a direction of the relative movement; a step-difference amount calculation device which measures positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtains an amount of step difference between the sub-heads represented by difference or ratio of the measured positions in the direction of the relative movement of the dot rows for the respective sub-heads; an adjustment value calculation device which calculates an adjustment value for the drive timing of the plurality of recording elements with respect to each of the plurality of sub-heads according to the obtained amount of step difference; and a drive timing adjustment device which adjusts relative drive timing with respect to each of the plurality of sub-heads according to the calculated adjustment value.

An inkjet recording apparatus including an inkjet head as a recording head is included in the image recording apparatus relating to the present invention.

Desirably, the step-difference amount calculation device measures the positions in the direction of the relative movement of the dot rows formed by the respective sub-heads by taking, as the measurement object, a region formed by using the recording elements belonging to a central portion including the central recording element in the direction of the relative movement, of the dot rows formed by the overlapping portion.

Another aspect of the present invention is directed to an image recording apparatus comprising: a recording head having a structure in which a plurality of sub-heads each including a plurality of recording elements are joined together; a recording head drive device which causes relative movement between a recording medium and the recording head and drives the plurality of recording elements at prescribed drive timing with respect to each of the plurality of sub-heads; a drive control device which controls the recording head drive device to form dot rows for the respective sub-heads, the dot rows extending in a direction substantially perpendicular to a direction of the relative movement; a step-difference amount calculation device which measures positions in the direction of the relative movement of the dot rows formed by the respective sub-heads are measured by taking, as a measurement object, a region formed by using the recording elements belonging to a central portion including the central recording element in the direction of the relative movement, and obtains an amount of step difference between the sub-heads represented by difference or ratio of the measured positions in the direction of the relative movement of the dot rows for the respective sub-heads; an adjustment value calculation device which calculates an adjustment value for the drive timing of the plurality of recording elements with respect to each of the plurality of sub-heads according to the obtained amount of step difference; and a drive timing adjustment device which adjusts relative drive timing with respect to each of the plurality of sub-heads according to the calculated adjustment value.

Desirably, the overlapping portion includes a recording element belonging to one sub-head and a recording element belonging to another sub-head in combination, in a projected recording element row in which the recording elements are projected so as to align in the direction substantially perpendicular to the direction of the relative movement; and each of the sub-heads has a structure in which number of recording elements decreases toward an end portion.

Desirably, an overlapping portion between the mutually adjacent sub-heads includes a recording element belonging to one sub-head and a recording element belonging to another sub-head in combination, in a projected recording element row in which the recording elements are projected so as to align in the direction substantially perpendicular to the direction of the relative movement; and each of the sub-heads has a structure in which number of recording elements decreases toward an end portion.

Desirably, the recording head is a full line head having a length corresponding to an entire width of the recording medium in a breadthways direction which is substantially perpendicular to the direction of the relative movement.

When performing single-pass image recording for recording an image on the entire image formation region of a recording medium by using a full line type recording head according to this aspect and performing just one relative scanning action of the recording head and a recording medium, the existence of a step difference between sub-heads affects image quality. An image recording apparatus relating to the present invention is able to eliminate a step difference between sub-heads, and therefore image recording of high quality is performed.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording head adjustment method comprising:

a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement;

a step-difference amount calculation step of measuring positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtaining an amount of step difference between the sub-heads represented by difference or ratio of the measured positions in the direction of the relative movement of the dot rows for the respective sub-heads;

an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value, wherein:

in the dot row forming step, a plurality of first dot rows in the direction substantially perpendicular to the direction of the relative movement are formed at a prescribed arrangement interval in the direction of the relative movement by using one sub-head of the mutually adjacent sub-heads, and a second dot row in the direction substantially perpendicular to the direction of the relative movement is formed between the plurality of first dot rows by using the other sub-head of the mutually adjacent sub-heads, and in the step-difference amount calculation step, the amount of step difference between the mutually adjacent sub-heads is calculated according to measurement result of measuring pitches between the plurality of first dot rows and the second dot row.

2. The recording head adjustment method as defined in claim 1, wherein in the dot row forming step, the dot rows are formed in such a manner that a dot forming portion where a dot is formed and a dot omission portion where a dot is omitted are included in the dot rows formed by using the overlapping portion and in such a manner that the dot forming portion of the dot row formed by one sub-head of the mutually adjacent sub-heads corresponds to a position, in the direction of the relative movement, of the dot omission portion of the dot row formed by the other sub-head of the mutually adjacent sub-heads.

3. The recording head adjustment method as defined in claim 1, wherein in the step-difference amount calculation step, the positions in the direction of the relative movement of the dot rows formed by the respective sub-heads are measured by taking, as the measurement object, a region formed by using the recording elements belonging to a central portion including the central recording element in the direction of the relative movement, of the dot rows formed by the overlapping portion.

4. The recording head adjustment method as defined in claim 1, wherein the positions in the direction of the relative movement of the dot rows formed by the respective sub-heads are measured by excluding, from the measurement object, regions formed by using the recording elements in both end portions in the direction of the relative movement, of the dot rows formed by the overlapping portion.

5. A recording head adjustment method comprising:

a dot row forming step of causing relative movement between a recording medium and a recording head in which a plurality of sub-heads each including a plurality of recording elements are joined together, and driving the plurality of recording elements at prescribed drive timing with respect to each of the plurality of sub-heads in such a manner that dot rows for the respective sub-heads are formed in a direction substantially perpendicular to a direction of the relative movement;

a step-difference amount calculation step of measuring positions in the direction of the relative movement of the dot rows formed by the respective sub-heads are measured by taking, as a measurement object, a region formed by using the recording elements belonging to a central portion including the central recording element in the direction of the relative movement, and obtaining an amount of step difference between the sub-heads represented by difference or ratio of the measured positions in the direction of the relative movement of the dot rows for the respective sub-heads;

an adjustment value calculation step of calculating an adjustment value for the drive timing of the plurality of recording elements with respect to each of the plurality of sub-heads according to the obtained amount of step difference; and a drive timing adjustment step of adjusting relative drive timing with respect to each of the plurality of sub-heads according to the calculated adjustment value, wherein:

in the dot row forming step, a plurality of first dot rows in the direction substantially perpendicular to the direction of the relative movement are formed at a prescribed arrangement interval in the direction of the relative movement by using one sub-head of the mutually adjacent sub-heads, and a second dot row in the direction substantially perpendicular to the direction of the relative movement is formed between the plurality of first dot rows by using the other sub-head of the mutually adjacent sub-heads, and in the step-difference amount calculation step, the amount of step difference between the mutually adjacent sub-heads is calculated according to measurement result of measuring pitches between the plurality of first dot rows and the second dot row.

6. An image recording apparatus comprising:

a recording head having a structure in which a plurality of sub-heads each including a plurality of recording elements are joined together;

a recording head drive device which causes relative movement between a recording medium and the recording head and drives the plurality of recording elements at prescribed drive timing with respect to each of the plurality of sub-heads;

a drive control device which controls the recording head drive device to form dot rows for the respective sub-heads, the dot rows extending in a direction substantially perpendicular to a direction of the relative movement;

a step-difference amount calculation device which measures positions in the direction of the relative movement of the dot rows for the respective sub-heads in a situation where a range of a part of the dot rows formed by an overlapping portion between the mutually adjacent sub-heads where recording rates represented by number of dots per unit surface area are substantially same as each other is set as a measurement object, and obtains an amount of step difference between the sub-heads represented by difference or ratio of the measured positions in the direction of the relative movement of the dot rows for the respective sub-heads;

an adjustment value calculation device which calculates an adjustment value for the drive timing of the plurality of recording elements with respect to each of the plurality of sub-heads according to the obtained amount of step difference; and a drive timing adjustment device which adjusts relative drive timing with respect to each of the plurality of sub-heads according to the calculated adjustment value, wherein:

a plurality of first dot rows in the direction substantially perpendicular to the direction of the relative movement are formed at a prescribed arrangement interval in the direction of the relative movement by using one sub-head of the mutually adjacent sub-heads, and a second dot row in the direction substantially perpendicular to the direction of the relative movement is formed between the plurality of first dot rows by using the other sub-head of the mutually adjacent sub-heads, and the amount of step difference between the mutually adjacent sub-heads is calculated according to a result of measuring pitches between the plurality of first dot rows and the second dot row.

7. The image recording apparatus as defined in claim 6, wherein the step-difference amount calculation device measures the positions in the direction of the relative movement of the dot rows formed by the respective sub-heads by taking, as the measurement object, a region formed by using the recording elements belonging to a central portion including the central recording element in the direction of the relative movement, of the dot rows formed by the overlapping portion.

8. An image recording apparatus comprising:

a recording head having a structure in which a plurality of sub-heads each including a plurality of recording elements are joined together;

a recording head drive device which causes relative movement between a recording medium and the recording head and drives the plurality of recording elements at prescribed drive timing with respect to each of the plurality of sub-heads;

a drive control device which controls the recording head drive device to form dot rows for the respective sub-heads, the dot rows extending in a direction substantially perpendicular to a direction of the relative movement;

a step-difference amount calculation device which measures positions in the direction of the relative movement of the dot rows formed by the respective sub-heads are measured by taking, as a measurement object, a region formed by using the recording elements belonging to a central portion including the central recording element in the direction of the relative movement, and obtains an amount of step difference between the sub-heads represented by difference or ratio of the measured positions in the direction of the relative movement of the dot rows for the respective sub-heads;

an adjustment value calculation device which calculates an adjustment value for the drive timing of the plurality of recording elements with respect to each of the plurality of sub-heads according to the obtained amount of step difference; and a drive timing adjustment device which adjusts relative drive timing with respect to each of the plurality of sub-heads according to the calculated adjustment value, wherein:

a plurality of first dot rows in the direction substantially perpendicular to the direction of the relative movement are formed at a prescribed arrangement interval in the direction of the relative movement by using one sub-head of the mutually adjacent sub-heads, and a second dot row in the direction substantially perpendicular to the direction of the relative movement is formed between the plurality of first dot rows by using the other sub-head of the mutually adjacent sub-heads, and the amount of step difference between the mutually adjacent sub-heads is calculated according to measurement result of measuring pitches between the plurality of first dot rows and the second dot row.

9. The image recording apparatus as defined in claim 6, wherein:

the overlapping portion includes a recording element belonging to one sub-head and a recording element belonging to another sub-head in combination, in a projected recording element row in which the recording elements are projected so as to align in the direction substantially perpendicular to the direction of the relative movement; and each of the sub-heads has a structure in which number of recording elements in the projected recording element row decreases toward an end portion of the projected recording element row.

10. The image recording apparatus as defined in claim 8, wherein:

an overlapping portion between the mutually adjacent sub-heads includes a recording element belonging to one sub-head and a recording element belonging to another sub-head in combination, in a projected recording element row in which the recording elements are projected so as to align in the direction substantially perpendicular to the direction of the relative movement; and each of the sub-heads has a structure in which number of recording elements in the projected recording element row decreases toward an end portion of the projected recording element row.

11. The image recording apparatus as defined in claim 6, wherein the recording head is a full line head having a length corresponding to an entire width of the recording medium in a breadthways direction which is substantially perpendicular to the direction of the relative movement.

12. The image recording apparatus as defined in claim 8, wherein the recording head is a full line head having a length corresponding to an entire width of the recording medium in a breadthways direction which is substantially perpendicular to the direction of the relative movement.

* * * * *